US009536481B2

(12) United States Patent
Yoon et al.

(10) Patent No.: US 9,536,481 B2
(45) Date of Patent: Jan. 3, 2017

(54) LIQUID CRYSTAL DISPLAY PANEL WITH UNIT PIXELS SHARING COMMON WHITE AREA

(71) Applicant: Samsung Display Co., LTD., Yongin, Gyeonggi-Do (KR)

(72) Inventors: Seon-Tae Yoon, Seoul (KR); Jae-Byung Park, Seoul (KR); Hae-Il Park, Seoul (KR); Kwang-Keun Lee, Osan-si (KR); Baek-Hee Lee, Yongin-si (KR); Mun-Ki Sim, Seoul (KR); Jun-Han Lee, Incheon (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 168 days.

(21) Appl. No.: 14/338,499

(22) Filed: Jul. 23, 2014

(65) Prior Publication Data

US 2015/0187301 A1 Jul. 2, 2015

(30) Foreign Application Priority Data

Dec. 30, 2013 (KR) ..... 10-2013-0166851

(51) Int. Cl.
*G09G 3/36* (2006.01)

(52) U.S. Cl.
CPC ..... *G09G 3/36* (2013.01); *G09G 2300/0452* (2013.01); *G09G 2300/0465* (2013.01)

(58) Field of Classification Search
CPC .... G09G 3/007; G09G 3/2074; G09G 3/2083; G09G 3/3607; G09G 3/364; G09G 3/3644
See application file for complete search history.

(56) References Cited

U.S. PATENT DOCUMENTS

| | | | | |
|---|---|---|---|---|
| 7,580,097 | B2 | 8/2009 | Moon et al. | |
| 2004/0130559 | A1* | 7/2004 | Lee | G09G 3/2011 345/690 |
| 2007/0075627 | A1* | 4/2007 | Kimura | H01L 27/3213 313/503 |
| 2007/0146296 | A1* | 6/2007 | Kang | G09G 3/3406 345/102 |

(Continued)

FOREIGN PATENT DOCUMENTS

| | | | |
|---|---|---|---|
| JP | 2008-209582 | A | 9/2008 |
| JP | 5236422 | B2 | 4/2013 |

(Continued)

*Primary Examiner* — Sanghyuk Park
(74) *Attorney, Agent, or Firm* — Cantor Colburn LLP

(57) ABSTRACT

A liquid crystal display panel includes unit pixels including a first unit pixel and a second unit pixel, each of the first unit pixel and the second unit pixel including a first white area and first to third color areas, gate lines which extend in a first direction, cross the unit pixels and include a first gate line and a second gate line, data lines which extend in a second direction, and pixel electrodes which are electrically connected to the data lines and include first to seventh pixel electrodes, where the first to third pixel electrodes overlap the first to third color areas of the first unit pixel, respectively, the fourth to sixth pixel electrodes overlap the first to third color areas of the second unit pixel, respectively, and the seventh pixel electrode overlaps the first white areas of the first and second unit pixels.

18 Claims, 14 Drawing Sheets

(56) References Cited

U.S. PATENT DOCUMENTS

| | | | | |
|---|---|---|---|---|
| 2008/0049048 | A1* | 2/2008 | Credelle | G09G 3/2074 345/690 |
| 2008/0316413 | A1 | 12/2008 | Cho | |
| 2009/0046233 | A1* | 2/2009 | Cho | G02F 1/133707 349/141 |
| 2010/0219414 | A1* | 9/2010 | Kim | H01L 27/124 257/71 |
| 2012/0206512 | A1 | 8/2012 | Kim et al. | |

FOREIGN PATENT DOCUMENTS

| | | | |
|---|---|---|---|
| KR | 10-0475115 | B1 | 2/2005 |
| KR | 1020090085353 | A | 8/2009 |
| KR | 10-1290168 | B1 | 7/2013 |

* cited by examiner

LIQUID CRYSTAL DISPLAY PANEL WITH UNIT PIXELS SHARING COMMON WHITE AREA

This application claims priority to Korean Patent Application No. 10-2013-0166851, filed on Dec. 30, 2013, and all the benefits accruing therefrom under 35 U.S.C. §119, the contents of which in its entirety is herein incorporated by reference.

BACKGROUND

1. Field

Exemplary embodiments of the invention relate to a liquid crystal display ("LCD") panel. More particularly, exemplary embodiments of the invention relate to an LCD panel capable of improving display quality.

2. Description of the Related Art

A liquid crystal display ("LCD") panel may include an array substrate, an opposing substrate and an LCD layer therebetween. The array substrate may include a plurality of pixel electrodes arranged in a matrix shape. A signal driving part may be configured to apply a desired voltage to the pixel electrodes to drive the LCD panel. A plurality of liquid crystal molecules in the LCD layer may be aligned due to an electric field generated by the voltage.

The LCD panel may include a plurality of color filters. The color filters may be disposed on the array substrate and/or the opposing substrate. In an exemplary embodiment, the color filters may include a red filter (R), a green filter (G) and a blue filter (B). The pixel electrodes may overlap the color filters. The pixel electrodes may be configured to transmit backlight as red light, green light or blue light according to an alignment of the liquid crystal molecules. A pixel area non-overlapping the color filters may transmit the backlight as white light (W).

If the LCD panel includes an RGBW pixel structure in which a unit pixel includes a red light transmitting area, a green light transmitting area, a blue light transmitting area and a white light transmitting area, then the pixel electrodes may include a plurality of domains to increase the transmitting areas of the color lights in order to improve color-sharpness and viewing angle of the LCD panel.

SUMMARY

When a white light transmitting area is relatively small in size, a backlight may be diffracted due to small domains in pixel electrodes in the white light transmitting area, thereby reducing color-sharpness of a liquid crystal display ("LCD") panel.

One or more exemplary embodiment of the invention provides an LCD panel having an RGBW pixel structure capable of improving color-sharpness of a display image.

In an exemplary embodiment of an LCD panel according to the invention, the LCD panel includes a plurality of unit pixels including a first unit pixel and a second unit pixel adjacent to each other, a plurality of gate lines extending in a first direction and crossing the unit pixels, a plurality of data lines extending in a second direction which crosses the first direction and a plurality of pixel electrodes electrically connected to the plurality of data lines respectively. The unit pixels include a first color area, a second color area, a third color area different from each other and a first white area, respectively. The plurality of gate lines includes a first gate line and a second gate line adjacent to each other. The pixel electrodes include a first pixel electrode, a second pixel electrode, a third pixel electrode, a fourth pixel electrode, a fifth pixel electrode, a sixth pixel electrode and a seventh pixel electrode. The first to the third pixel electrodes overlap the first to the third color areas of the first unit pixel respectively. The fourth to the sixth pixel electrodes overlap the first to the third color areas of the second unit pixel respectively. The seventh pixel electrode is disposed between the first gate line and the second gate line. The seventh pixel electrode overlaps the first white area of the first unit pixel and the first white area of the second unit pixel.

In an exemplary embodiment, the first to the third pixel electrodes may be arranged along the first direction. Dispositions of the fourth to the sixth pixel electrodes may be substantially symmetrical to dispositions of the first to the third pixel electrodes with respect to the seventh pixel electrodes.

In an exemplary embodiment, a second size of the seventh pixel electrodes may be substantially greater than a first size of one of the first pixel electrode, the second pixel electrode and the third pixel electrode.

In an exemplary embodiment, the second size may be greater than about two times of the first size and smaller than about three times of the first size.

In an exemplary embodiment, a plurality of slits tilted from the first direction and the second direction and may be defined in the pixel electrodes, respectively. A first width of one of the plurality of slits of the first pixel electrode, the second pixel electrode and the third pixel electrode may be substantially equal to or less than a second width of the seventh pixel electrode.

In an exemplary embodiment, the first to the third color areas of the first unit pixel may be disposed at a first side of the first gate line. The first white area of the first unit pixel may be disposed at a second side of the first gate line opposite to the first side of the first gate line. The first to the third color areas of the second unit pixel may be disposed at a first side of the second gate line. The first white area of the second unit pixel may be disposed at a second side of the second gate line opposite to the first side of the second gate line.

In an exemplary embodiment, the seventh pixel electrode may be electrically connected to the first gate line.

In an exemplary embodiment, the seventh pixel electrode may be electrically connected to the second gate line. The first gate line and the second gate line may be configured to receive synchronized gate signals.

In an exemplary embodiment, the plurality of data lines may include a first data line electrically connected to the first pixel electrode and the fourth pixel electrode, a second data line electrically connected to the second pixel electrode and the fifth pixel electrode, a third data line electrically connected to the third pixel electrode and the sixth pixel electrode and a fourth data line electrically connected to the seventh pixel electrode.

In an exemplary embodiment, at least one of the first data line, the second data line, the third data line and the fourth data line may be disposed between two pixel electrodes among the first pixel electrode, the second pixel electrode and the third pixel electrode.

In an exemplary embodiment, the second unit pixel may be adjacent to the first unit pixel in the second direction. A seventh data voltage applied to the seventh pixel electrode via the fourth data line may be determined based on first to sixth data voltages respectively applied to the first to the sixth pixel electrode.

In an exemplary embodiment, the seventh data voltage may be one of a minimum value, a maximum value and an average value among the first to the sixth data voltages.

In an exemplary embodiment, the second unit pixel may be adjacent to the first unit pixel in the second direction. The unit pixels may further include a third unit pixel adjacent to the first unit pixel in the first direction and a fourth unit pixel adjacent to the third unit pixel in the second direction. The first unit pixel may further include a second white area adjacent to the first white area in the first direction. The second white area may be adjacent to the seventh pixel electrode in the first direction. The second white area may overlap an eighth pixel electrode which partially overlaps the second unit pixel, the third unit pixel and the fourth unit pixel.

In an exemplary embodiment, the pixel electrodes may further include a ninth pixel electrode, a tenth pixel electrode and an eleventh pixel electrode respectively overlapping a first color area, a second color area and a third color area of the third unit pixel and a twelfth pixel electrode, a thirteenth pixel electrode and a fourteenth pixel electrode respectively overlapping a first color area, a second color area and a third color area of the fourth unit pixel. An eighth data voltage applied to the eighth pixel electrode may be one of a minimum value, a maximum value and an average value among first to sixth data voltages respectively applied to the first to the sixth pixel electrodes and ninth to fourteenth data voltages respectively applied to the ninth to the fourteenth pixel electrodes.

In an exemplary embodiment, the unit pixels may further include a third unit pixel adjacent to the first unit pixel in the first direction and a fourth unit pixel opposite to the third unit pixel with respect to the third unit pixel. A first color area, a second color area and a third color area of the third unit pixel and a first color area, a second color area and a third color area of the fourth unit pixel may be disposed between the first gate line and the second gate line.

In an exemplary embodiment, the fourth unit pixel, the first unit pixel and the third unit pixel may be disposed in a zigzag shape along the first direction.

In an exemplary embodiment, the pixel electrodes may further include a ninth pixel electrode, a tenth pixel electrode and an eleventh pixel electrode respectively overlapping the first to the third color areas of the third unit pixel and a twelfth pixel electrode, a thirteenth pixel electrode and a fourteenth pixel electrode respectively overlapping the first to the third color areas of the fourth unit pixel. The first unit pixel may further include a second white area adjacent to the first white area in the first direction. The second white area may be adjacent to the seventh pixel electrode in the first direction. The second white area may overlap an eighth pixel electrode which partially overlaps the second unit pixel, the third unit pixel and the fourth unit pixel. An eighth data voltage applied to the eighth pixel electrode may be one of a minimum value, a maximum value and an average value among first to sixth data voltages respectively applied to the first to the sixth pixel electrodes and ninth to fourteenth data voltages respectively applied to the ninth to the fourteenth pixel electrodes.

In an exemplary embodiment, the LCD panel may further include a light blocking pattern overlapping the plurality of gate lines and the plurality of data lines. The light blocking pattern may include a plurality of opening areas.

In an exemplary embodiment, the light blocking pattern may include a plurality of first opening areas overlapping the first color areas, the second color areas and the third color areas of the first and the second unit pixels and a second opening area overlapping the first white areas of the first and the second unit pixels. The second opening area may be disposed between the first gate line and the second gate line.

In an exemplary embodiment, a third area of the first opening areas overlapping the first unit pixel may be substantially the same as a fourth area of the second opening area.

According to one or more exemplary embodiment of the LCD panel, white areas in unit pixels in a RGBW pixel structure may overlap a pixel electrode which is greater in size and broader in slit-width than individual color areas (i.e., a red area, a green area and a blue area) in the unit pixels, and the pixel electrode may be independently or dependently driven from the color areas, thereby reducing diffraction of backlight due to white domain size and improving color-sharpness of a display image.

Also, adjacent unit pixels may share a single white area, thereby reducing number of switching elements for controlling a pixel electrode overlapping the single white area and improving yield rate of the LCD panel.

Furthermore, an opening area of a light blocking pattern covering the switching elements may be broaden, thereby improving transmissivity of the LCD panel.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
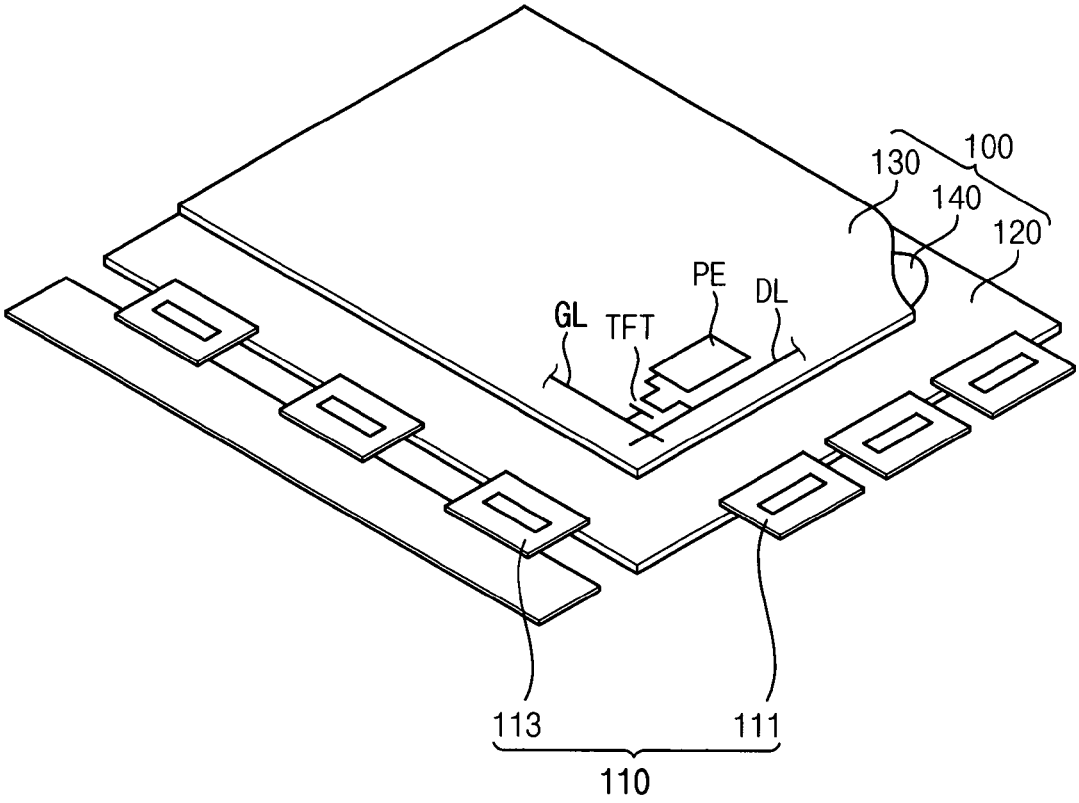
FIG. 1 is a perspective view illustrating a liquid crystal display ("LCD") panel according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in further detail with reference to the accompanying drawings.

FIG. 1 is a perspective view illustrating a liquid crystal display ("LCD") panel according to an exemplary embodiment of the invention.

Referring to FIG. 1, an LCD panel 100 according to the exemplary embodiment may include an array substrate 120, an opposing substrate 130 and an LCD layer 140.

The array substrate 120 may include a plurality of gate lines GL, a plurality of data lines DL, a plurality of switching element TFT and a plurality of pixel electrodes PE. The switching elements TFT may electrically connect the pixel electrodes PE with the gate lines GL and the data lines DL. The pixel electrodes PE may define sub-pixel areas.

The opposing substrate 130 may face the array substrate 120.

The liquid crystal layer 140 may be disposed between the array substrate 120 and the opposing substrate 130.

One of the array substrate 120 and the opposing substrate 130 may include a color filter pattern overlapping the sub-pixel areas. In an exemplary embodiment, the LCD panel 100 may have a color filter on array substrate ("COA") structure in which the color filter pattern is disposed on the array substrate 120, for example. In an alternative exemplary embodiment, the color filter pattern may be disposed on the opposing substrate 130. The color filter pattern may include, e.g., a red filter, a green filter and a blue filter, etc. In an alternative exemplary embodiment, the color filter pattern may include a color phosphor or a nano-particle to convert backlight having a blue light or an ultraviolet waveband into red light, green light, yellow light, etc. Hereinafter, transmitting areas of the red light, the green light, the blue light and a white light may be referred as a red area, a green area, a blue area and a white area, respectively.

One of the array substrate 120 and the opposing substrate 130 may include a light blocking pattern. The light blocking pattern may overlap a border line of the sub-pixel areas. In an exemplary embodiment, the LCD panel 100 may have a black matrix on array substrate ("BOA") structure in which the light blocking pattern is disposed on the array substrate 120, for example. In an alternative exemplary embodiment, the light blocking pattern may be disposed on the opposing substrate 130.

One of the array substrate 120 or the opposing substrate 130 may include a common electrode to generate an electric field with the pixel electrodes PE. In an exemplary embodiment, the LCD panel 100 may have a plane-to-line switching ("PLS") structure in which the common electrode is disposed on the array substrate 120 and horizontal electric fields generated by the pixel electrodes and the common electrode adjust alignments of liquid crystal molecules in the liquid crystal layer 140, for example. In the PLS structure, a plurality of slits may be defined in the pixel electrodes PE or the common electrode. In an alternative exemplary embodiment, the common electrode may be disposed on the opposing substrate 130.

The LCD panel 100 may receive an image signal from an image driving part 110.

The image driving part 110 may include a gate driving part 111 and a data driving part 113. The gate driving part 111 may be configured to output gate on/off voltages to the gate lines GL. As illustrated in FIG. 1, the gate driving part 111 and the data driving part 113 may be embedded as a tape carrier package ("TCP") form in the LCD panel 100. In other exemplary embodiments, the gate driving part 111 and/or the data driving part 113 may be integrated on the array substrate 120.

The data driving part 113 may be configured to output data voltages to the data lines DL.

Figure 2:
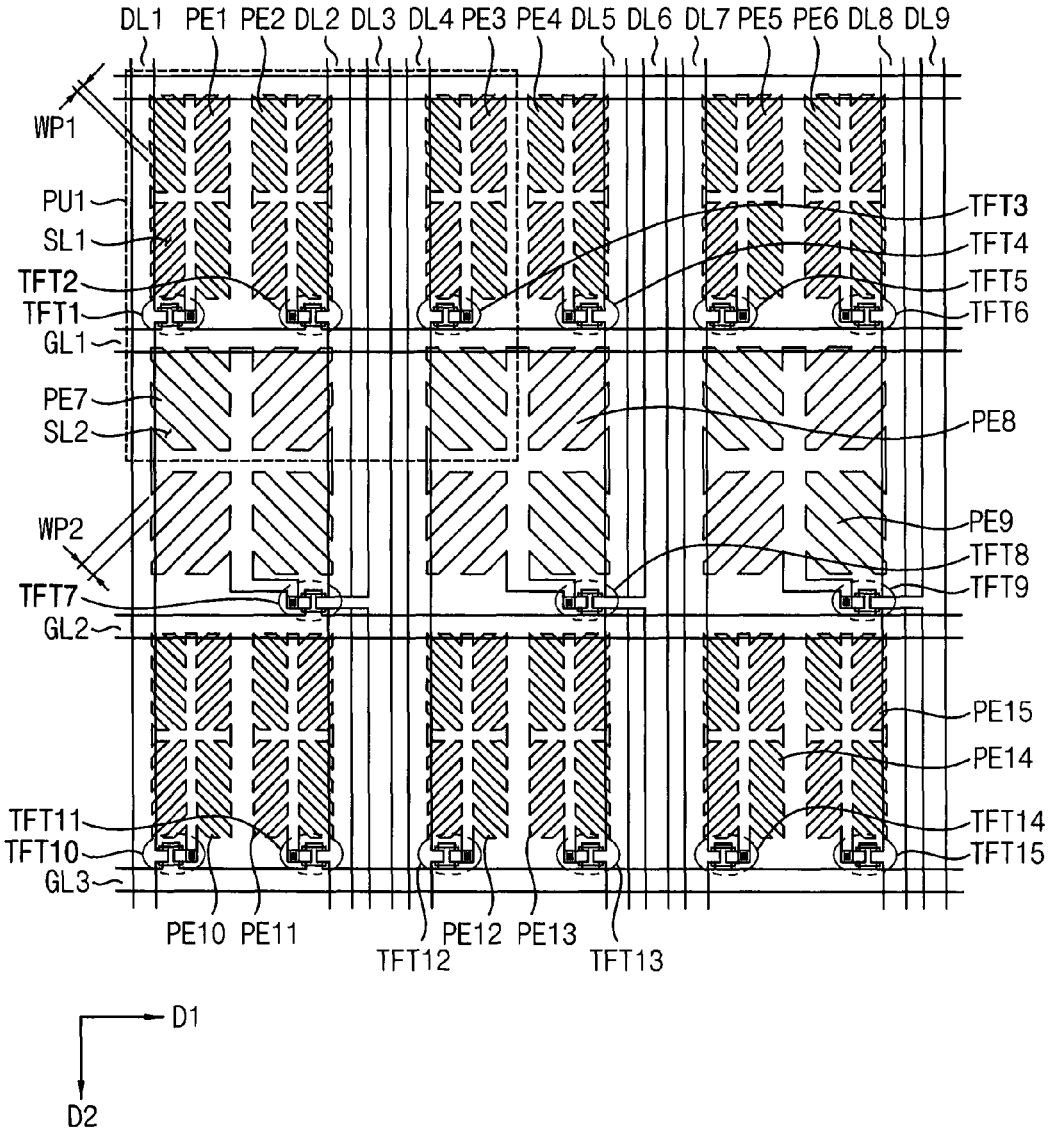
FIG. 2 is a plan view illustrating a pixel structure of the LCD panel in FIG. 1.
Figure 3A:
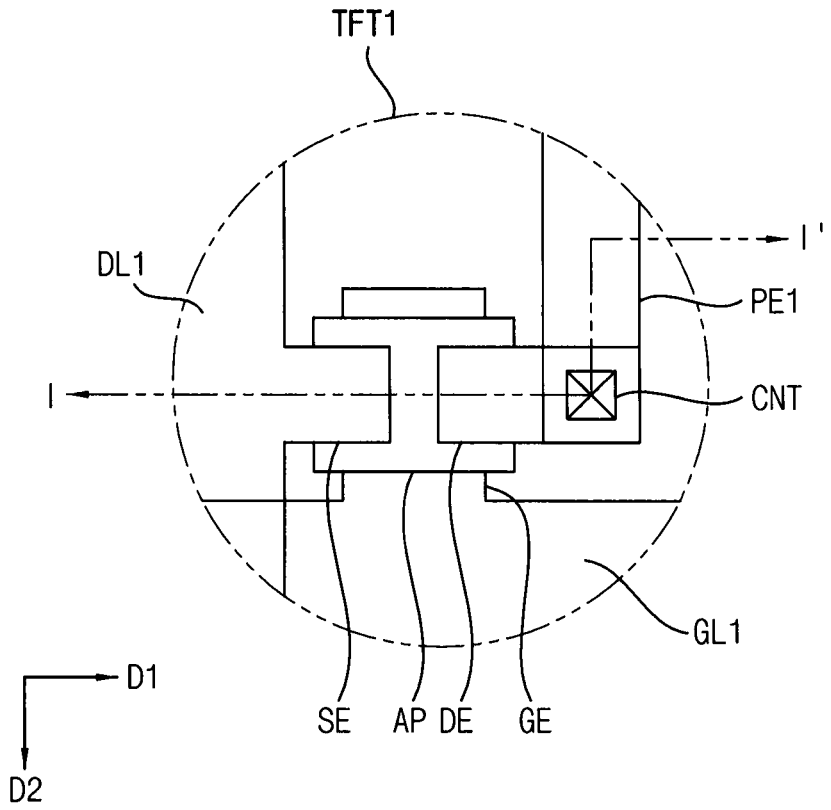
FIG. 3A is an enlarged plan view illustrating a switching element in FIG. 2.
Figure 3B:
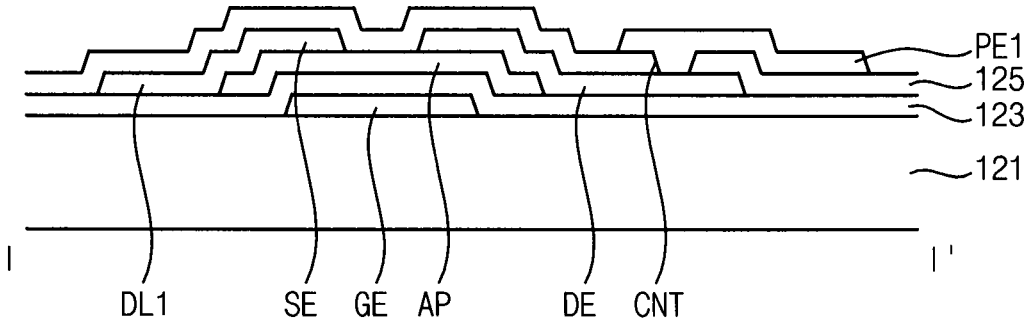
FIG. 3B is a cross-sectional view taken along line I-I' of FIG. 3A.

FIG. 2 is a plan view illustrating a pixel structure of the LCD panel in FIG. 1. FIG. 3A is an enlarged plan view illustrating a switching element in FIG. 2. FIG. 3B is a cross-sectional view taken along line I-I' of FIG. 3A.

Referring to FIGS. 2, 3A and 3B, an array substrate 120 of the LCD panel 100 according to the illustrated exemplary embodiment may include a base substrate 121, gate lines GL1, GL2 and GL3, a gate insulation layer 123, data lines DL1 to DL9, a passivation layer 125, pixel electrodes PE1 to PE15 and switching elements TFT1 to TFT15. Each of the switching elements TFT1 to TFT15 may include a gate electrode GE, a source electrode SE, an active pattern AP and a drain electrode DE.

A display area of the LCD panel 100 may be divided by a plurality of unit pixels including a first unit pixel PU1. The first unit pixel PU1 may at least partially overlap a desired number of the pixel electrodes PE.

In an exemplary embodiment, the base substrate 121 may include a transparent insulation material. In an exemplary embodiment, the base substrate 121 may include glass, quartz, plastic, polyethylene terephthalate resin, polyethylene resin, polycarbonate resin, etc.

The gate lines GL1, GL2 and GL3 may extend in a first direction D1 on the base substrate 121. The gate lines GL1, GL2 and GL3 may be arranged in a second direction D2 crossing the first direction D1. In an exemplary embodiment, the gate lines GL1, GL2 and GL3 may include, e.g., aluminum (Al), gold (Au), silver (Ag), copper (Cu), iron (Fe), nickel (Ni), etc. The-above described elements may be used alone or in any combinations thereof. In an exemplary embodiment, the gate lines GL1, GL2 and GL3 may include, e.g., indium doped zinc oxide ("IZO"), gallium doped zinc oxide ("GZO"), etc. The gate lines GL1, GL2 and GL3 may include a first gate line GL1, a second gate line GL2 and a third gate line GL3 sequentially adjacent to one another along the second direction D2.

The gate electrode GE may be electrically connected to each of the gate lines GL1, GL2 and GL3. In an exemplary embodiment, the gate electrode GE may include, for example, a same material as the gate lines GL1, GL2 and GL3. In an exemplary embodiment, the gate electrode GE may be unitary with each of the gate lines GL1, GL2 and GL3.

The gate insulation layer 123 may be disposed on the base substrate 121 on which the gate lines GL1, GL2 and GL3 and the gate electrode GE are disposed. In an exemplary embodiment, the gate insulation layer 123 may include a transparent insulation material such as, for example, silicon oxide, silicon nitride, etc.

The active pattern AP may be disposed on the gate insulation layer 123. The active pattern AP may overlap the gate electrode GE. In an exemplary embodiment, the active pattern AP may include, e.g., indium (In), zinc (Zn), gallium (Ga), tin (Sn), hafnium (Hf), etc. In an exemplary embodiment, the active pattern AP may include an oxide semiconductor pattern such as, e.g., indium gallium zinc oxide ("IGZO"), indium tin zinc oxide ("ITZO"), hafnium indium zinc oxide ("HIZO"), etc.

The data lines DL1 to DL9 may be disposed on the base substrate 121 on which the active pattern AP is disposed. The data lines DL1 to DL9 may extend in the second direction D2. The data lines DL1 to DL9 may be arranged in the first direction D1. In an exemplary embodiment, the second direction D2 may be substantially perpendicular to the first direction D1. The data lines DL1 to DL9 and the gate lines GL1, GL2 and GL3 may define a plurality of sub-pixel areas. However, the invention is not limited thereto, and the plurality of sub-pixel areas may not be defined by the data lines DL1 to DL9 and the gate lines GL1, GL2 and GL3. In an exemplary embodiment, the data lines DL1 to DL9 may include, e.g., a same material as the gate lines GL1, GL2 and GL3. In an exemplary embodiment, the data lines DL1 to DL9 may include aluminum (Al), gold (Au), silver (Ag), copper (Cu), iron (Fe), nickel (Ni), etc. The data lines DL1 to DL9 may include a first data line DL1, a second data line DL2, a third data line DL3, a fourth data line DL4, a fifth data line DL5, a sixth data line DL6, a seventh data line DL7, an eighth data line DL8 and a ninth data line DL9 sequentially adjacent to one another along the first direction D1.

The source electrode SE may be disposed on the gate insulation layer 123. The source electrode SE may overlap a first end portion (e.g., left portion) of the active pattern AP. The source electrode SE may be electrically connected to each of the data lines DL1 to DL9. In an exemplary embodiment, the source electrode SE may be unitary with the data lines DL1 to DL9.

The drain electrode DE may be spaced apart from the source electrode SE. The drain electrode DE may be disposed on the gate insulation layer 123. The drain electrode DE may overlap a second end portion (e.g., right portion) of the active pattern AP. The drain electrode DE may include, e.g., a same material as the source electrode SE. In an exemplary embodiment, the source electrode SE and the drain electrode DE may include aluminum (Al), gold (Au), silver (Ag), copper (Cu), iron (Fe), nickel (Ni), etc.

The passivation layer 125 may be disposed on the source electrode SE and the drain electrode DE. The passivation layer 125 may cover the source electrode SE and the drain electrode DE. The passivation layer 125 may include an inorganic insulation material or an organic insulation material. In an exemplary embodiment, the passivation layer 125 may include a same material as that of the gate insulation layer 123, for example. In an exemplary embodiment, the passivation layer 125 may include silicon oxide, silicon nitride, etc.

The pixel electrodes PE1 to PE15 may be disposed on the passivation layer 125. In an exemplary embodiment, the pixel electrodes PE1 to PE15 may include, e.g., a transparent conductive material. Each of the pixel electrodes PE1 to PE15 may be electrically connected to the drain electrode DE through a contact hole CNT defined in the passivation layer 125.

The pixel electrodes PE1 to PE15 may include a first pixel electrode PE1 and a second pixel electrode PE2. The first pixel electrode PE1 may be electrically connected to the first gate line GL1 and the first data line DL1 by a first switching element TFT1. The second pixel electrode PE2 may be electrically connected to the first gate line GL1 and the second data line DL2 by a second switching element TFT2.

The pixel electrodes PE1 to PE15 may include a third pixel electrode PE3 and a fourth pixel electrode PE4. The third pixel electrode PE3 may be electrically connected to the first gate line GL1 and the fourth data line DL4 by a third switching element TFT3. The fourth pixel electrode PE4 may be electrically connected to the first gate line GL1 and the fifth data line DL5 by a fourth switching element TFT4.

The pixel electrodes PE1 to PE15 may include a fifth pixel electrode PE5 and a sixth pixel electrode PE6. The fifth pixel electrode PE5 may be electrically connected to the first gate line GL1 and the seventh data line DL7 by a fifth switching element TFT5. The sixth pixel electrode PE6 may be electrically connected to the first gate line GL1 and the eighth data line DL8 by a sixth switching element TFT6.

The pixel electrodes PE1 to PE15 may include a seventh pixel electrode PE7, an eighth pixel electrode PE8 and a ninth pixel electrode PE9. The seventh pixel electrode PE7 may be electrically connected to the second gate line GL2 and the third data line DL3 by a seventh switching element TFT7. The eighth pixel electrode PE8 may be electrically connected to the second gate line GL2 and the sixth data line DL6 by an eighth switching element TFT8. The ninth pixel electrode PE9 may be electrically connected to the second gate line GL2 and the ninth data line DL9 by a ninth switching element TFT9. The seventh to the ninth pixel electrodes PE7, PE8 and PE9 may be disposed between the first gate line GL1 and the second gate line GL2.

The pixel electrodes PE1 to PE15 may include a tenth pixel electrode PE10 and an eleventh pixel electrode PE11. The tenth pixel electrode PE10 may be electrically connected to the third gate line GL3 and the first data line DL1 by a tenth switching element TFT10. The eleventh pixel electrode PE11 may be electrically connected to the third gate line GL3 and the second data line DL2 by an eleventh switching element TFT11.

The pixel electrodes PE1 to PE15 may include a twelfth pixel electrode PE12 and a thirteenth pixel electrode PE13. The twelfth pixel electrode PE12 may be electrically connected to the third gate line GL3 and the fourth data line DL4 by a twelfth switching element TFT12. The thirteenth pixel electrode PE13 may be electrically connected to the third gate line GL3 and the fifth data line DL5 by a thirteenth switching element TFT13.

The pixel electrodes PE1 to PE15 may include a fourteenth pixel electrode PE14 and a fifteenth pixel electrode PE15. The fourteenth pixel electrode PE14 may be electrically connected to the third gate line GL3 and the seventh data line DL7 by a fourteenth switching element TFT14. The fifteenth pixel electrode PE15 may be electrically connected to the third gate line GL3 and the eighth data line DL8 by a fifteenth switching element TFT15.

A plurality of slits tilted toward a desired angle with respect to the first direction D1 and the second direction D2 may be defined in each of the pixel electrodes PE1 to PE15. In an exemplary embodiment, first slits SL1 having a first width WP1 may be defined in the first to the sixth pixel electrodes PE1 to PE6 and the tenth to the fifteenth pixel electrodes PE10 to PE15. In an exemplary embodiment, the first width WP1 may be greater than about 1 micrometer (μm) and smaller than about 10 μm, for example. In an exemplary embodiment, second slits SL2 having a second width WP2 may be defined in the seventh to the ninth pixel electrodes PE7 to PE9. The second width WP2 may be substantially equal to or greater than the first width WP1. In an exemplary embodiment, the second width WP2 may be greater than about 1 μm and smaller than about 10 μm, for example.

Sizes of the pixel electrodes PE1 to PE15 may be different from one another. In an exemplary embodiment, the first to the sixth pixel electrodes PE1 to PE6 and the tenth to the fifteenth pixel electrodes PE10 to PE15 may have a first area, respectively. In an exemplary embodiment, the seventh to the ninth pixel electrodes PE7 to PE9 may have a second area, respectively. The second area may be substantially greater than the first area. In an exemplary embodiment, the second area may be greater than about two times of the first area and smaller than about three times of the first area, for example. In an exemplary embodiment, the second area may be about two times of the first area, for example.

One or more of the data lines DL1 to DL9 may be disposed between the pixel electrodes PE1 to PE15. In an exemplary embodiment, the second to the fourth data lines DL2 to DL4 may be disposed between the second pixel electrode PE2 and the third pixel electrode PE3. The second to the fourth data lines DL2 to DL4 may be disposed between the seventh pixel electrode PE7 and the eighth pixel electrode PE8. The second to the fourth data lines DL2 to DL4 may be disposed between the eleventh pixel electrode PE11 and the twelfth pixel electrode PE12.

In a similar manner, the fifth to the seventh data lines DL5 to DL7 may be disposed between the fourth pixel electrode PE4 and the fifth pixel electrode PE5 and between the eighth pixel electrode PE8 and the ninth pixel electrode PE9 and between the thirteenth pixel electrode PE13 and the fourteenth pixel electrode PE14.

As mentioned above, three data lines DL2 to DL4 or DL5 to DL7 may be disposed between two of the pixel electrodes PE1 to PE6 electrically connected to the first gate line GL1. Also, the three data lines DL2 to DL4 or DL5 to DL7 may be disposed between two of the pixel electrodes PE7 to PE9 electrically connected to the second gate line GL2. Also, the three data lines DL2 to DL4 or DL5 to DL7 may be disposed between two of the pixel electrodes PE10 to PE15 electrically connected to the third gate line GL3.

Data voltages applied to the pixel electrodes PE1 to PE15 through the data lines DL1 to DL9 will be described in detail referring to FIG. 5.

Figure 4:
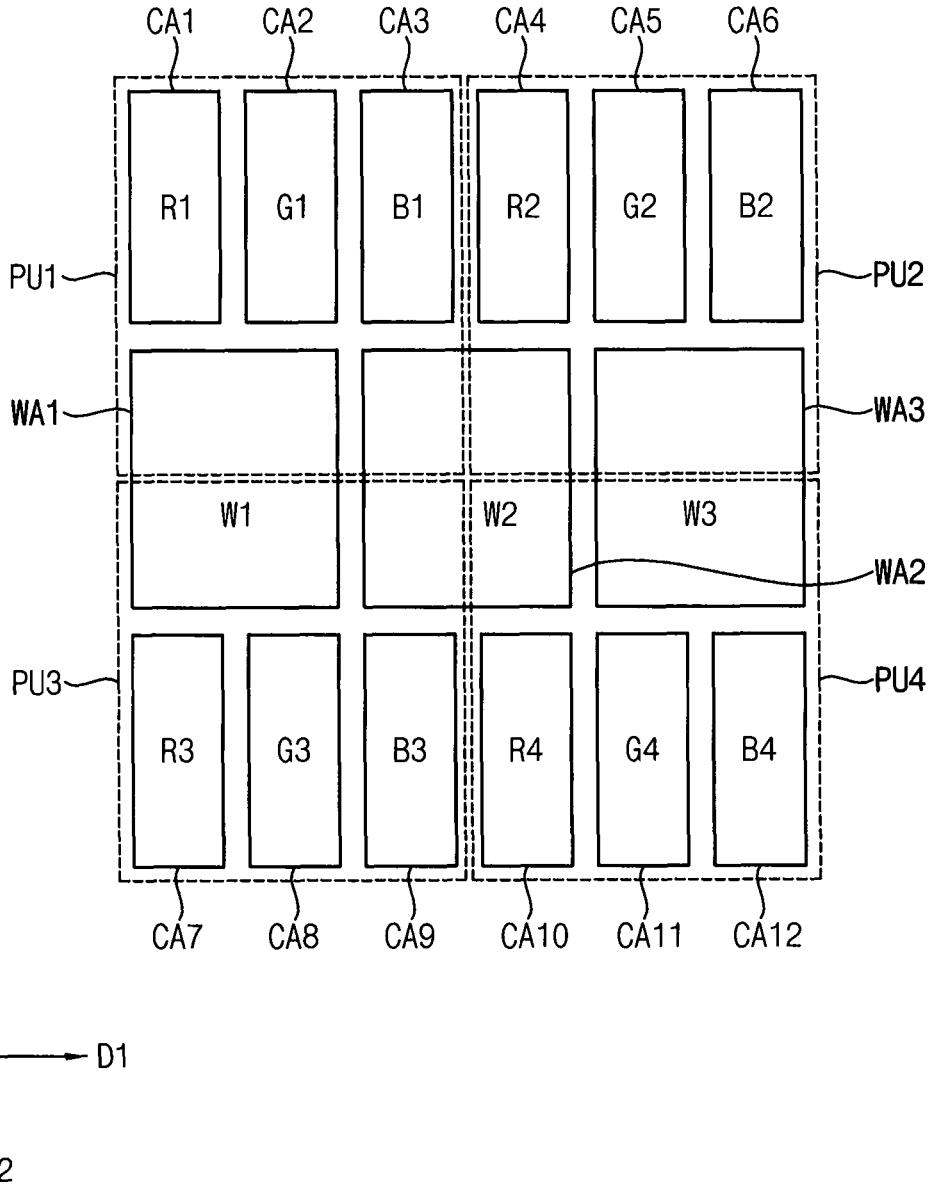
FIG. 4 is a plan view illustrating light transmitting areas of the LCD panel in FIG. 2.

FIG. 4 is a plan view illustrating light transmitting areas of the LCD panel in FIG. 2. FIG. 5 is a plan view illustrating a light blocking pattern of the LCD panel in FIG. 2.

Figure 5:
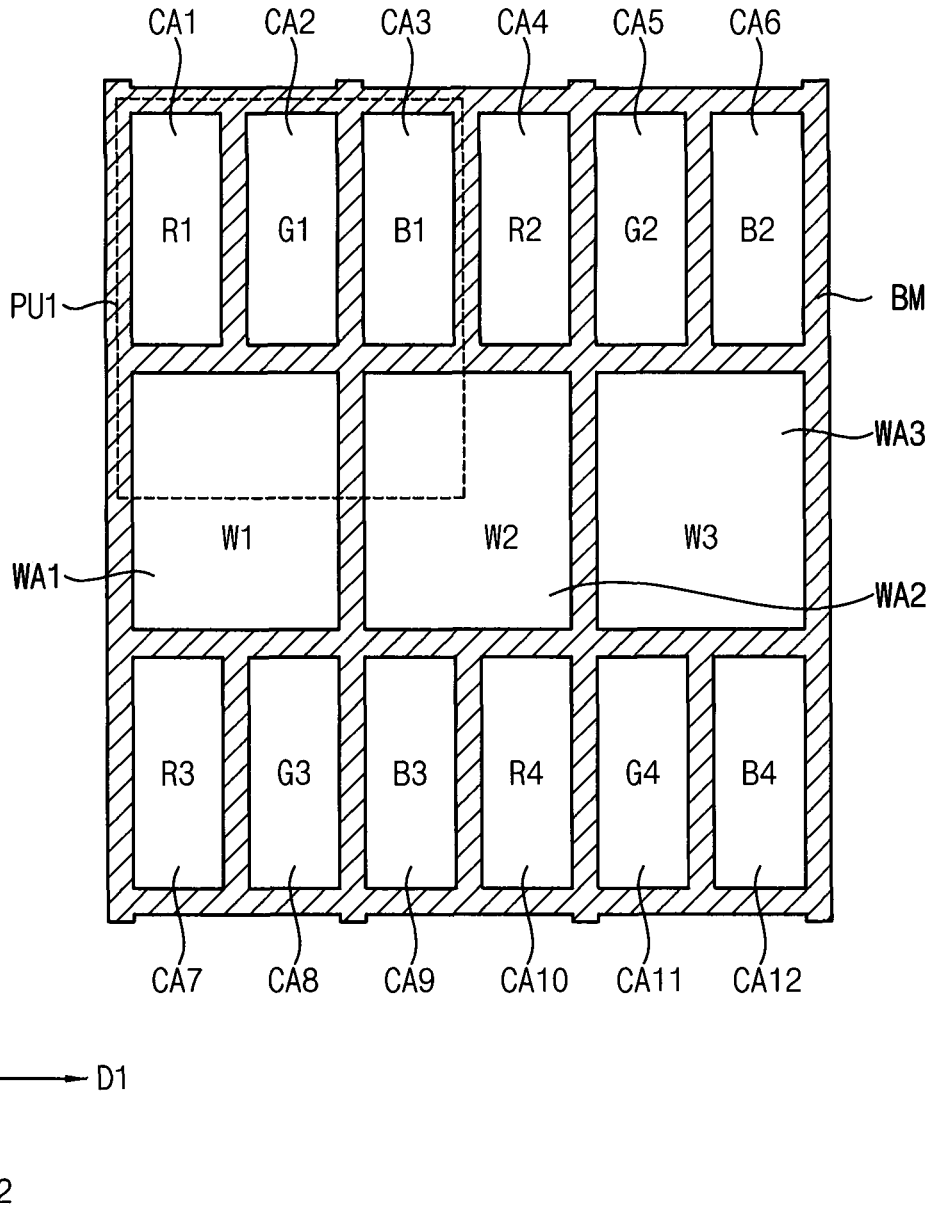
FIG. 5 is a plan view illustrating a light blocking pattern of the LCD panel in FIG. 2.

Referring to FIGS. 2, 4 and 5, the LCD panel 100 according to the illustrated exemplary embodiment may include a plurality of unit pixels PU1, PU2, PU3 and PU4. The unit pixels PU1 to PU4 may be arranged in a matrix shape along the first direction D1 and the second direction D2. The unit pixels PU1 to PU4 may include a red area through which red light transmits, a green area through which green light transmits, a blue area through which blue light transmits and a white area through which white light transmits.

The unit pixels PU1 to PU4 may include a first unit pixel PU1. The first unit pixel PU1 may include a first color area CAL a second color area CA2 and a third color area CA3. The first unit pixel PU1 may partially overlap a first white area WA1 and a second white area WA2.

The unit pixels PU1 to PU4 may include a second unit pixel PU2. The second unit pixel PU2 may include a fourth color area CA4, a fifth color area CA5 and a sixth color area CA6. The second unit pixel PU2 may partially overlap the second white area WA2 and a third white area WA3. The second unit pixel PU2 may be adjacent to the first pixel unit PU1 in the first direction D1.

The unit pixels PU1 to PU4 may include a third unit pixel PU3. The third unit pixel PU3 may include a seventh color area CA7, an eighth color area CA8 and a ninth color area CA9. The third unit pixel PU3 may partially overlap the first white area WA1 and the second white area WA2. The third unit pixel PU3 may be adjacent to the first pixel unit PU1 in the second direction D2.

The unit pixels PU1 to PU4 may include a fourth unit pixel PU4. The fourth unit pixel PU4 may include a tenth color area CA10, an eleventh color area CA11 and a twelfth color area CA12. The fourth unit pixel PU4 may partially overlap the second white area WA2 and the third white area WA3. The fourth unit pixel PU4 may be adjacent to the second unit pixel PU2 in the second direction D2.

The first to the third color areas CA1 to CA3, the fourth to the sixth color areas CA4 to CA6, the seventh to the ninth color areas CA7 to CA9 and the tenth to the twelfth color areas CA10 to CA12 may be the red area, the green area and the blue area, respectively. An order of colors in the color areas CA1 to CA12 may be differently determined in other exemplary embodiments. In an exemplary embodiment, the first to the third color areas CA1 to CA3 may have an arbitrary order in which the red area, the green area and the blue area are arranged.

The color areas CA1 to CA6, the white areas WA1 to WA3 and the color areas CA7 to CA12 may be at least partially overlap one or more of the first to the fifteenth pixel electrodes PE1 to PE15, respectively. In an exemplary embodiment, the first to the sixth color areas CA1 to CA6 may overlap the first to sixth pixel electrodes PE1 to PE6, respectively. In an exemplary embodiment, the first to the third whit areas WA1 to WA3 may overlap the seventh to the ninth pixel electrodes PE7 to PE9, respectively. In an exemplary embodiment, the seventh to the twelfth color areas CA7 to CA12 may overlap the tenth to the fifteenth pixel electrodes PE10 to PE15, respectively.

Data voltages having a first red value R1, a first green value G1 and a first blue value B1 may be applied to the first pixel electrode PE1, the second pixel electrode PE2 and the third pixel electrode PE3 which overlap the first color area CA1, the second color area CA2 and the third color area CA3 of the first unit pixel PU1, respectively. Data voltages having a second red value R2, a second green value G2 and a second blue value B2 may be applied to the fourth pixel electrode PE4, the fifth pixel electrode PE5 and the sixth pixel electrode PE6 which overlap the fourth color area CA4, the fifth color area CA5 and the sixth color area CA6 of the second unit pixel PU2, respectively. Data voltages having a third red value R3, a third green value G3 and a third blue value B3 may be applied to the tenth pixel electrode PE10, the eleventh pixel electrode PE11 and the twelfth pixel electrode PE12 which overlap the seventh color area CA7, the eighth color area CA8 and the ninth color area CA9 of the third unit pixel PU3, respectively. Data voltages having a fourth red value R4, a fourth green value G4 and a fourth blue value B4 may be applied to the thirteenth pixel electrode PE13, the fourteenth pixel electrode PE14 and the fifteenth pixel electrode PE15 which overlap the tenth color area CA10, the eleventh color area CA11 and the twelfth color area CA12, respectively.

A data voltage applied to the seventh pixel electrode PE7 which overlaps the first white area WA1 and partially covers both the first unit pixel PU1 and the second unit pixel PU2 may be determined based on color values of the color areas CA1 to CA3 in the first unit pixel PU1 and the color areas CA7 to CA9 in the second unit pixel PU2.

In an exemplary embodiment, a first white value W1 applied to the seventh pixel electrode PE7 may be a minimum value among the first red value R1, the first green value G1, the third red value R3 and the third green value G3 as Equation 1.

$$W1=\min\{R1,G1,R3,G3\} \quad \text{Equation 1}$$

In an exemplary embodiment, a first white value W1 applied to the seventh pixel electrode PE7 may be a maximum value among the first red value R1, the first green value G1, the third red value R3 and the third green value G3 as Equation 2.

$$W1=\max\{R1,G1,R3,G3\} \quad \text{Equation 2}$$

In an exemplary embodiment, a first white value W1 applied to the seventh pixel electrode PE7 may be an average value among the first red value R1, the first green value G1, the third red value R3 and the third green value G3 as Equation 3.

$$W1=(R1+G1+R3+G3)/4 \quad \text{Equation 3}$$

In an exemplary embodiment, a first white value W1 applied to the seventh pixel electrode PE7 may be a minimum value among the first red value R1, the first green value G1, the first blue value B1, the third red value R3, the third green value G3 and the third blue value B3 as Equation 4.

$$W1=\min\{R1,G1,B1,R3,G3,B3\} \quad \text{Equation 4}$$

In an exemplary embodiment, a first white value W1 applied to the seventh pixel electrode PE7 may be a maximum value among the first red value R1, the first green value G1, the first blue value B1, the third red value R3, the third green value G3 and the third blue value B3 as Equation 5.

$$W1=\max\{R1,G1,B1,R3,G3,B3\} \quad \text{Equation 5}$$

In an exemplary embodiment, a first white value W1 applied to the seventh pixel electrode PE7 may be an average value among the first red value R1, the first green value G1, the first blue value B1, the third red value R3, the third green value G3 and the third blue value B3 as Equation 6.

$$W1=(R1+G1+B1+R3+G3+B3)/6 \quad \text{Equation 6}$$

In a similar manner, a third white value W3 applied to the ninth pixel electrode PE9 which overlap the third white area WA3 and partially covers the second unit pixel PU2 and the fourth unit pixel PU4 may be determined based on the color values of the color areas CA4 to CA6 and CA10 to CA12.

A data voltage applied to the eighth pixel electrode PE8 which overlap the second white area WA2 and partially overlap the first to the fourth unit pixels PU1 to PU4 may be determined based on color values of the color areas CA1 to CA12 in the first to the fourth unit pixels PU1 to PU4.

In an exemplary embodiment, a second white value W2 applied to the eighth pixel electrode PE8 may be a minimum value among the first to the fourth red values R1 to R4, the first to the fourth green values G1 to G4 and the first to the fourth blue values B1 to B4 as Equation 7.

$$W2=\min\{R1,G1,B1,R2,G2,B2,R3,G3,B3,R4,G4,B4\} \quad \text{Equation 7}$$

In an exemplary embodiment, a second white value W2 applied to the eighth pixel electrode PE8 may be a maximum value among the first to the fourth red values R1 to R4, the first to the fourth green values G1 to G4 and the first to the fourth blue values B1 to B4 as Equation 8.

$$W2=\max\{R1,G1,B1,R2,G2,B2,R3,G3,B3,R4,G4,B4\} \quad \text{Equation 8}$$

In an exemplary embodiment, a second white value W2 applied to the eighth pixel electrode PE8 may be an average value among the first to the fourth red values R1 to R4, the first to the fourth green values G1 to G4 and the first to the fourth blue values B1 to B4 as Equation 9.

$$W2=(R1+G1+B1+R2+G2+B2+R3+G3+B3+R4+G4+B4)/12 \quad \text{Equation 9}$$

As mentioned above, the first to the third white values W1 to W3 applied to the seventh to the ninth pixel electrodes PE7 to PE7 which overlap the first to the third white areas WA1 to WA3 may be determined based on one or more of color values of the color areas CA1 to CA12 in the first to the fourth unit pixels PU1 to PU4.

A second gate voltage to control the seventh to the ninth pixel electrodes PE7 to PE9 may be applied to the second gate line GL2 in a substantially different time from that of a first gate voltage applied to the first gate line GL1 to control the first to the sixth pixel electrodes PE1 to PE6.

In an alternative exemplary embodiment, the second gate voltage to control the seventh to the ninth pixel electrodes PE7 to PE9 may be applied to the second gate line GL2 in a substantially same time as the first gate voltage to control the first to the sixth pixel electrodes PE1 to PE6 is applied to the first gate line GL1. In an exemplary embodiment, the first gate line GL1 and the second gate line GL2 may be configured to receive synchronized gate signals.

Referring to FIG. 5, boundaries of the color areas CA1 to CA12 and the white areas WA1 to WA3 may be covered by a light blocking pattern BM. In an exemplary embodiment, the light blocking pattern BM may overlap the gate lines GL1 to GL3, the data lines DL1 to DL9 and the switching elements TFT1 to TFT15. The light blocking pattern BM may include, for example, an organic or inorganic material which absorbs light. In an exemplary embodiment, the light blocking pattern BM may include carbon black ("CB"), titan black (TiBK), chromium (Cr), chromium oxide, chromium nitride, etc.

A plurality of opening areas may be defined in the light blocking pattern BM. The opening areas may overlap the color areas CA1 to CA12 and the white areas WA1 to WA3. In an exemplary embodiment, first opening areas which overlap the color areas CA1 to CA12 may be defined in the light blocking pattern BM. Also, second opening areas which overlap the white areas WA1 to WA3 may be defined in the light blocking pattern BM. The second opening areas may be substantially greater than the first opening areas in size. In an exemplary embodiment, sizes of the second opening areas may be greater than about two times of one of the first opening areas and smaller than about three times of one of the first opening areas, for example.

Figure 6:
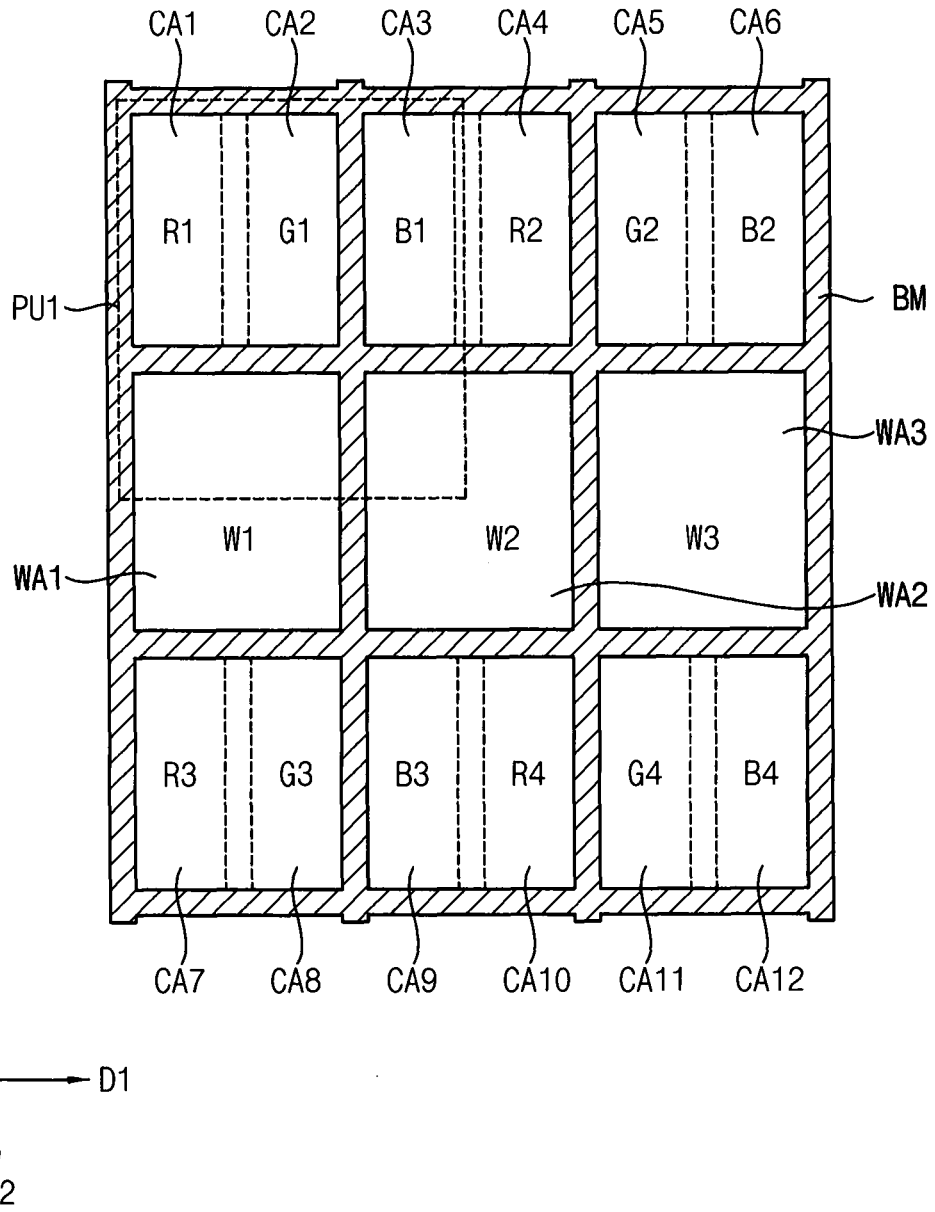
FIG. 6 is a plan view illustrating a light blocking pattern of the LCD panel in FIG. 2.

FIG. 6 is a plan view illustrating a light blocking pattern of the LCD panel in FIG. 2.

Referring to FIGS. 2, 5 and 6, a second opening area defined in a light blocking pattern BM of the LCD panel 100 may be substantially equal to a first opening area in size. In an exemplary embodiment, the first color area CA1 and the second color area CA2 of the first unit pixel PU1 may overlap the first opening area of the light blocking pattern BM. Accordingly, transmissivity of the LCD panel may be improved, thereby increasing luminance of a display image.

As mentioned above, according to exemplary embodiments of the LCD panel, the white areas in the unit pixels in a RGBW pixel structure may overlap a pixel electrode which is greater in size and broader in slit-width than individual color areas (i.e., a red area, a green area and a blue area) in the unit pixels, and the pixel electrode may be independently or dependently driven from the color areas, thereby reducing diffraction of backlight due to white domain size and improving color-sharpness of a display image.

Also, adjacent unit pixels may share a single white area, thereby reducing number of switching elements for controlling a pixel electrode overlapping the single white area and improving yield rate of the LCD panel.

Furthermore, the opening area of the light blocking pattern covering the switching elements may be broaden, thereby improving transmissivity of the LCD panel.

Figure 7:
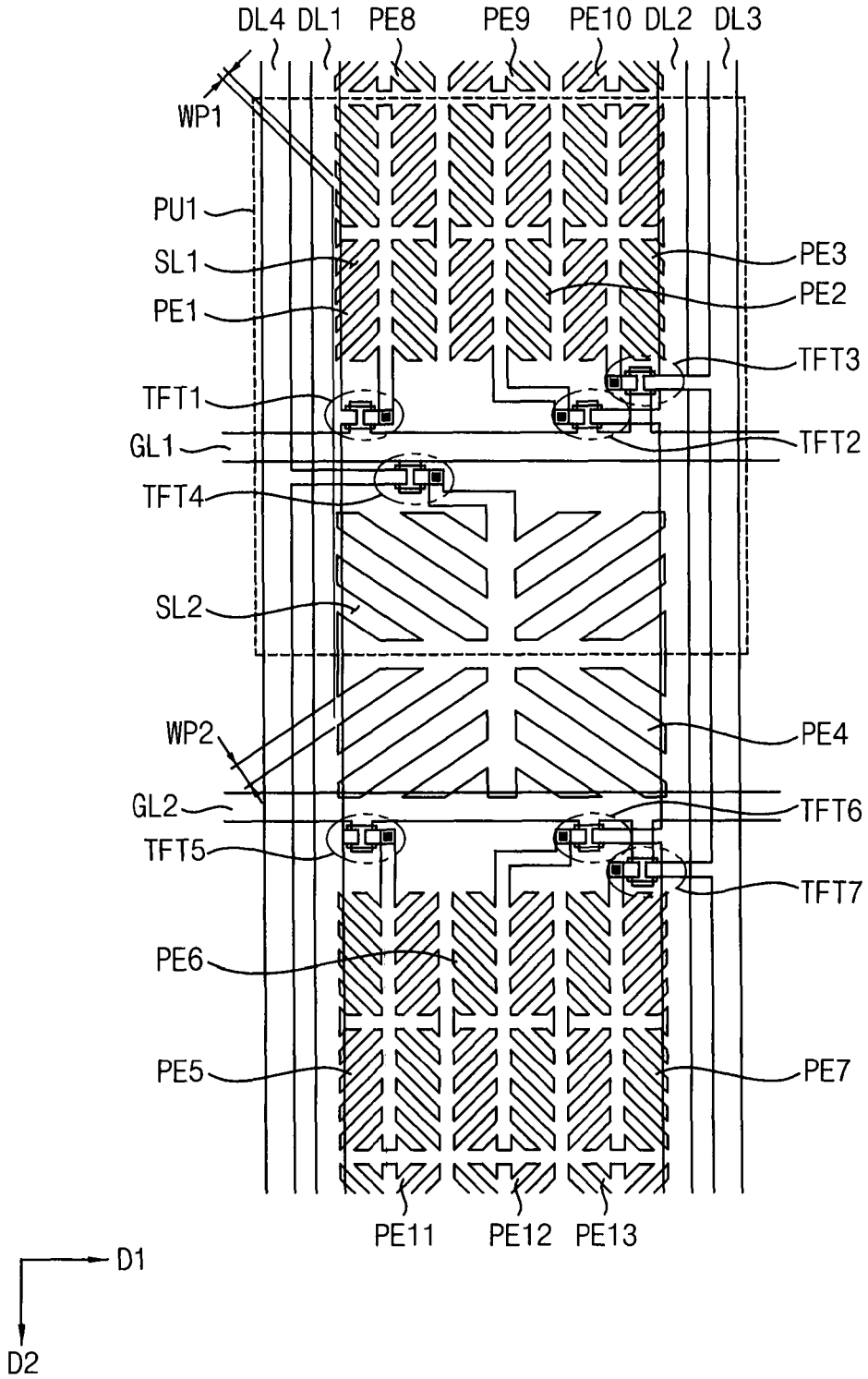
FIG. 7 is a plan view illustrating a pixel structure of an LCD panel according to an exemplary embodiment of the invention.
Figure 8:
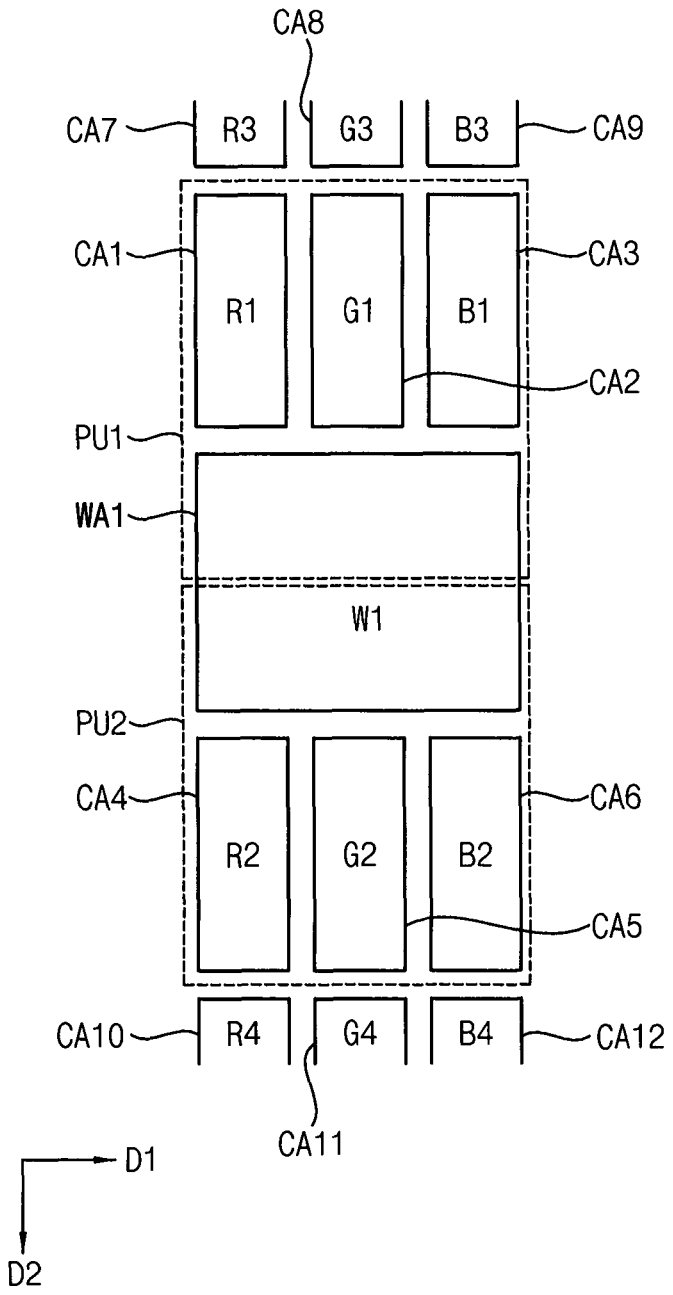
FIG. 8 is a plan view illustrating light transmitting areas of the LCD panel in FIG. 7.
Figure 9:
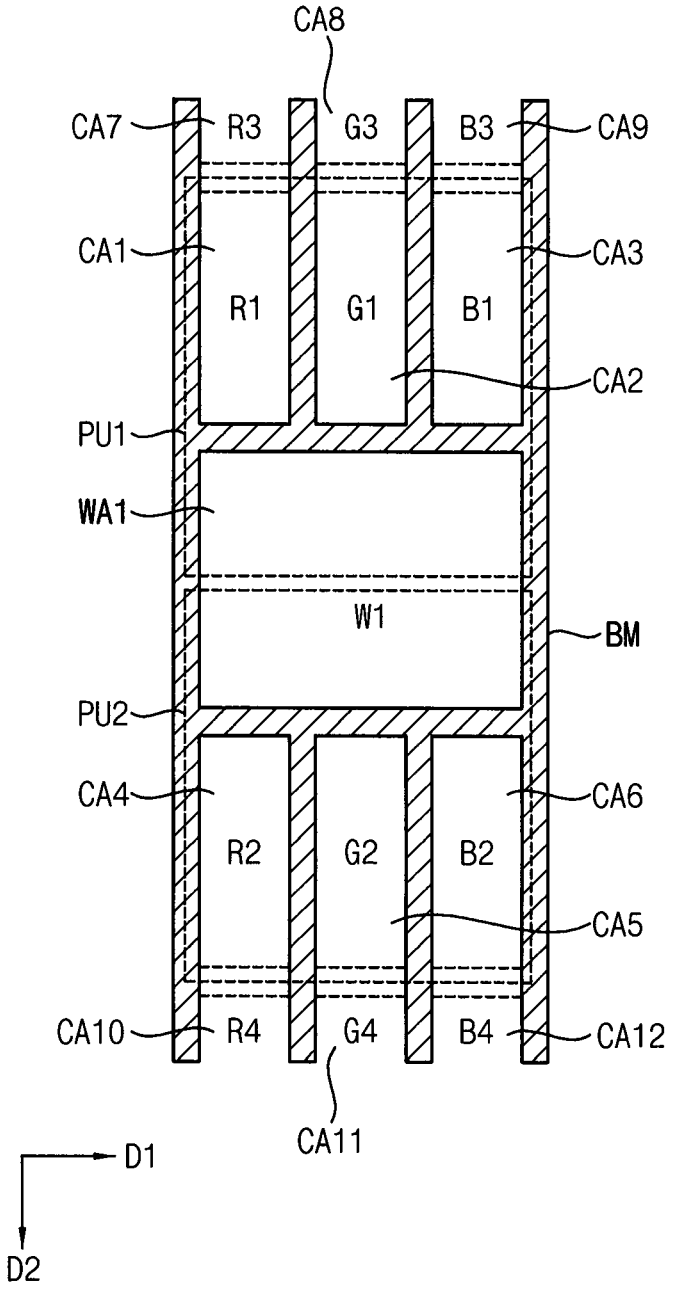
FIG. 9 is a plan view illustrating a light blocking pattern of the LCD panel in FIG. 7.

FIG. 7 is a plan view illustrating a pixel structure of an LCD panel according to an exemplary embodiment of the invention. FIG. 8 is a plan view illustrating light transmitting areas of the LCD panel in FIG. 7. FIG. 9 is a plan view illustrating a light blocking pattern of the LCD panel in FIG. 7.

Referring to FIGS. 7, 8 and 9, an LCD panel according to the illustrated exemplary embodiment may include a plurality of gate lines GL1 and GL2, a plurality of data lines DL1 to DL4, a plurality of pixel electrodes PE1 to PE13 and a plurality of switching elements TFT1 to TFT7. The switching elements TFT1 to TFT7 may be substantially the same as the switching element illustrated in FIGS. 3A and 3B.

A display area of the LCD panel may be divided by a plurality of unit pixels including a first unit pixel PU1.

The gate lines GL1 and GL2 may extend in a first direction D1. The gate lines GL1 and GL2 may be arranged in a second direction D2 crossing the first direction D1. The gate lines GL1 and GL2 may include a first gate line GL1 and a second gate line GL2 adjacent to each other along the second direction D2.

The data lines DL1 to DL4 may extend in the second direction D2. The data lines DL1 to DL4 may be arranged in the first direction D1. In an exemplary embodiment, the second direction D2 may be substantially perpendicular to the first direction D1, for example. The data lines DL1 to DL4 and the gate lines GL1 and GL2 may define a plurality of sub-pixel areas. However, the invention is not limited thereto, and the plurality of sub-pixel areas may not be defined by the data lines DL1 to DL4 and the gate lines GL1 and GL2. The data lines DL1 to DL4 may include a fourth data line DL4, a first data line DL1, a second data line DL2 and a third data line DL3 sequentially adjacent to one another along the first direction D1.

In an exemplary embodiment, the pixel electrodes PE1 to PE13 may include, e.g., a transparent conductive material.

The pixel electrodes PE1 to PE13 may include a first pixel electrode PE1, a second pixel electrode PE2 and a third pixel electrode PE3. The first pixel electrode PE1 may be electrically connected to the first gate line GL1 and the first data line DL1 by a first switching element TFT1. The second pixel electrode PE2 may be electrically connected to the first gate line GL1 and the second data line DL2 by a second switching element TFT2. The third pixel electrode PE3 may be electrically connected to the first gate line GL1 and the third data line DL3 by a third switching element TFT3.

The pixel electrodes PE1 to PE13 may include a fourth pixel electrode PE4. The fourth pixel electrode PE4 may be electrically connected to the first gate line GL1 and the fourth data line DL4 by a fourth switching element TFT4. The fourth pixel electrodes PE4 may be disposed between the first gate line GL1 and the second gate line GL2.

The pixel electrodes PE1 to PE13 may include a fifth pixel electrode PE5, a sixth pixel electrode PE6 and a seventh pixel electrode PE7. The fifth pixel electrode PE5 may be electrically connected to the second gate line GL2 and the first data line DL1 by a fifth switching element TFT5. The sixth pixel electrode PE6 may be electrically connected to the second gate line GL2 and the second data line DL2 by a sixth switching element TFT6. The seventh pixel electrode PE7 may be electrically connected to the second gate line GL2 and the third data line DL3 by a seventh switching element TFT7.

The pixel electrodes PE1 to PE13 may include an eighth pixel electrode PE8, a ninth pixel electrode PE9 and a tenth pixel electrode PE10. The eighth to the tenth pixel electrodes PE8 to PE10 may be disposed above the first unit pixel PU1 along the second direction D2. The eighth to the tenth pixel electrodes PE8 to PE10 may be disposed symmetrically to the first to the third pixel electrodes PE1 to PE3.

The pixel electrodes PE1 to PE13 may include an eleventh pixel electrode PE11, a twelfth pixel electrode PE12 and a thirteenth pixel electrode PE13. The eleventh to the thirteenth pixel electrodes PE11 to PE13 may be disposed below a second unit pixel which is adjacent to the first unit pixel PU1 along the second direction D2. The eleventh to the thirteenth pixel electrodes PE11 to PE13 may be disposed symmetrically to the fifth to the seventh pixel electrodes PE5 to PE7.

A plurality of slits tilted toward a desired angle with respect to the first direction D1 and the second direction D2 may be defined in each of the pixel electrodes PE1 to PE13. In an exemplary embodiment, first slits SL1 having a first width WP1 may be defined in the first to the third pixel electrodes PE1 to PE3 and the fifth to the seventh pixel electrodes PE5 to PE7. In an exemplary embodiment, second slits SL2 having a second width WP2 may be defined in the fourth pixel electrode PE4. The second width WP2 may be substantially equal to or greater than the first width WP1.

Sizes of the pixel electrodes PE1 to PE13 may be different from one another. In an exemplary embodiment, the first to the third pixel electrodes PE1 to PE3 and the fifth to the seventh pixel electrodes PE5 to PE7 may have a first area, respectively. In an exemplary embodiment, the fourth pixel electrode PE4 may have a second area. The second area may be substantially greater than the first area. In an exemplary embodiment, the second area may be greater than about two times of the first area, for example. In an exemplary embodiment, the second area may be about three times of the first area, for example.

In the illustrated exemplary embodiment, the data lines DL1 to DL4 may be disposed at border lines of the first unit pixel PU1.

Referring to FIGS. 8 and 9, the LCD panel may include a plurality of unit pixels PU1 and PU2. The unit pixels PU1 and PU2 may be arranged in a matrix shape along the first direction D1 and the second direction D2. The unit pixels PU1 and PU2 may include a red area through which red light transmits, a green area through which green light transmits, a blue area through which blue light transmits and a white area through which white light transmits.

The unit pixels PU1 and PU2 may include a first unit pixel PU1. The first unit pixel PU1 may include a first color area CAL a second color area CA2 and a third color area CA3. The first unit pixel PU1 may partially overlap a first white area WA1.

The unit pixels PU1 and PU2 may include a second unit pixel PU2. The second unit pixel PU2 may include a fourth color area CA4, a fifth color area CA5 and a sixth color area CA6. The second unit pixel PU2 may partially overlap the first white area WA1. The second unit pixel PU2 may be adjacent to the first pixel unit PU1 in the second direction D2.

The first to the third color areas CA1 to CA3 and the fourth to the sixth color areas CA4 to CA6 may be, e.g., the red area, the green area and the blue area, respectively. An order of colors in the color areas CA1 to CA6 may be differently determined in other exemplary embodiments. In an exemplary embodiment, the first to the third color areas CA1 to CA3 may have an arbitrary order in which the red area, the green area and the blue area are arranged.

A seventh color area CA7, an eighth color area CA8 and a ninth color area CA9 may be disposed above the first unit pixel PU1 along the second direction D2. A tenth color area CA10, an eleventh color area CA11 and a twelfth color area CA12 may be disposed below the second unit pixel which is adjacent to the first unit pixel PU1 along the second direction D2.

The color areas CA1 to CA3, the first white area WA1, and CA4 to CA12 may be at least partially overlap one or more of the first to the thirteenth pixel electrodes PE1 to PE13, respectively. In an exemplary embodiment, the first to the third color areas CA1 to CA3 may overlap the first to third pixel electrodes PE1 to PE3, respectively. In an exemplary embodiment, the first white area WA1 may overlap the fourth pixel electrode PE4. In an exemplary embodiment, the fourth to the sixth color areas CA4 to CA6 may overlap the fifth to the seventh pixel electrodes PE5 to PE7, respectively. In an exemplary embodiment, the seventh to the ninth color areas CA7 to CA9 may overlap the eighth to the tenth pixel electrodes PE8 to PE10, respectively. In an exemplary embodiment, the tenth to the twelfth color areas CA10 to CA12 may overlap the eleventh to the thirteenth pixel electrodes PE11 to PE13, respectively.

Data voltages having a first red value R1, a first green value G1 and a first blue value B1 may be applied to the first pixel electrode PE1, the second pixel electrode PE2 and the third pixel electrode PE3 which overlap the first color area CA1, the second color area CA2 and the third color area CA3 of the first unit pixel PU1, respectively. Data voltages having a second red value R2, a second green value G2 and a second blue value B2 may be applied to the fifth pixel electrode PE5, the sixth pixel electrode PE6 and the seventh pixel electrode PE7 which overlap the fourth color area CA4, the fifth color area CA5 and the sixth color area CA6, respectively. Data voltages having a third red value R3, a third green value G3 and a third blue value B3 may be applied to the eighth pixel electrode PE8, the ninth pixel electrode PE9 and the tenth pixel electrode PE10 which overlap the seventh color area CA7, the eighth color area CA8 and the ninth color area CA9, respectively. Data voltages having a fourth red value R4, a fourth green value G4 and a fourth blue value B4 may be applied to the eleventh pixel electrode PE11, the twelfth pixel electrode PE12 and the thirteenth pixel electrode PE13 which overlap the tenth color area CA10, the eleventh color area CA11 and the twelfth color area CA12, respectively.

A data voltage applied to the fourth pixel electrode PE4 which overlaps the first white area WA1 and partially covers both the first unit pixel PU1 and the second unit pixel PU2 may be determined based on color values of the color areas CA1 to CA3 in the first unit pixel PU1 and the color areas CA4 to CA6 in the second unit pixel.

In an exemplary embodiment, a first white value W1 applied to the fourth pixel electrode PE4 may be one of a minimum value, a maximum value and an average value among the first red value R1, the first green value G1, the first blue value B1, the third red value R3, the third green value G3 and the third blue value B3.

Referring to FIG. 9, boundaries of the color areas CA1 to CA12 and the first white area WA1 may be covered by a light blocking pattern BM. In an exemplary embodiment, the light blocking pattern BM may overlap the gate lines GL1 and GL2, the data lines DL1 to DL4 and the switching elements TFT1 to TFT7.

A plurality of opening areas may be defined in the light blocking pattern BM. The opening areas may overlap the color areas CA1 to CA12 and the first white area WA1. In an exemplary embodiment, first opening areas which overlap the color areas CA1 to CA12 may be defined in the light blocking pattern BM. In an exemplary embodiment, one of the first opening areas may overlap the first color area CA1 and the seventh color area CA7. Also, one of the first opening areas may overlap the second color area CA2 and the eighth color area CA8. Also, one of the first opening areas may overlap the third color area CA3 and the ninth color area CA9. As mentioned above, the first opening areas may overlap color areas having a same color in adjacent unit pixels.

Also, second opening area which overlaps the first white area WA1 may be defined in the light blocking pattern BM. The second opening area may be substantially greater than the first opening areas in size. In an exemplary embodiment, a width of the second opening area along the first direction D1 may be greater than about two times and smaller than about three times of a width of one of the first opening areas, for example.

Figure 10:
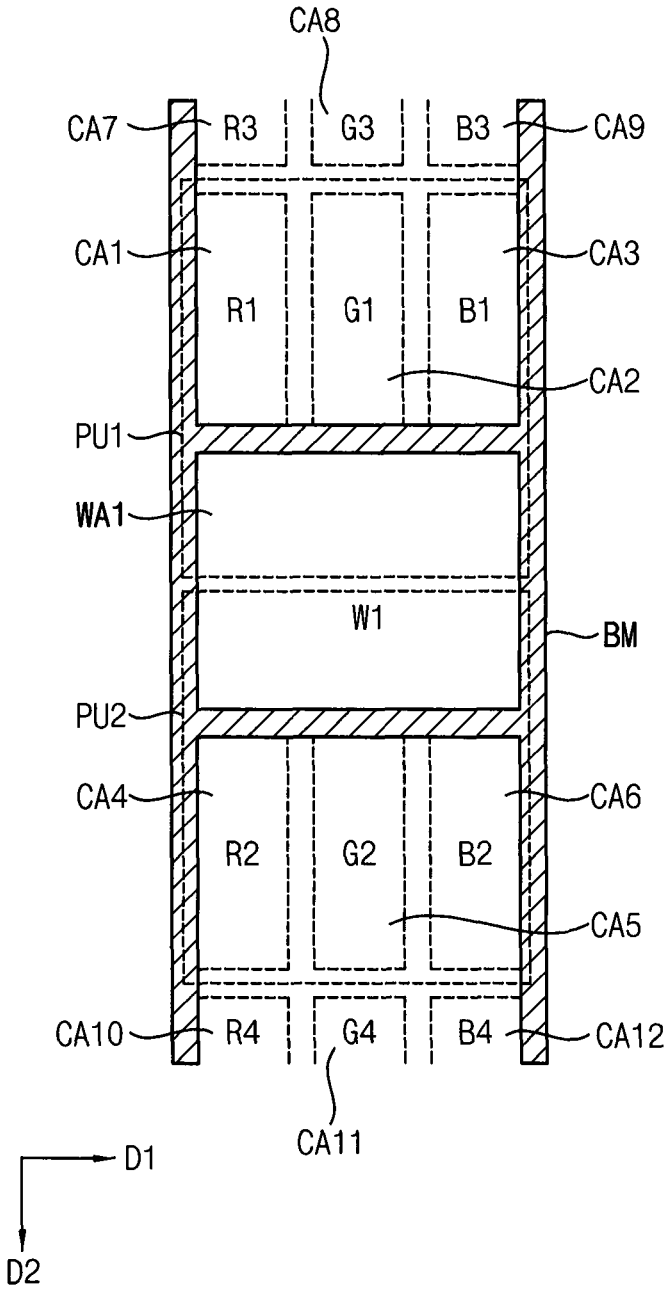
FIG. 10 is a plan view illustrating a light blocking pattern of the LCD panel in FIG. 7.

FIG. 10 is a plan view illustrating a light blocking pattern of the LCD panel in FIG. 7.

Referring to FIGS. 7, 9 and 10, a first opening area defined in a light blocking pattern BM of the LCD panel may be substantially greater than a second opening area in size. In an exemplary embodiment, the first to the third color areas CA1 to CA3 and the seventh to the ninth color areas CA7 to CA9 may overlap the first opening area of the light blocking pattern BM. Accordingly, transmissivity of the LCD panel may be improved, thereby increasing luminance of a display image.

Figure 11:
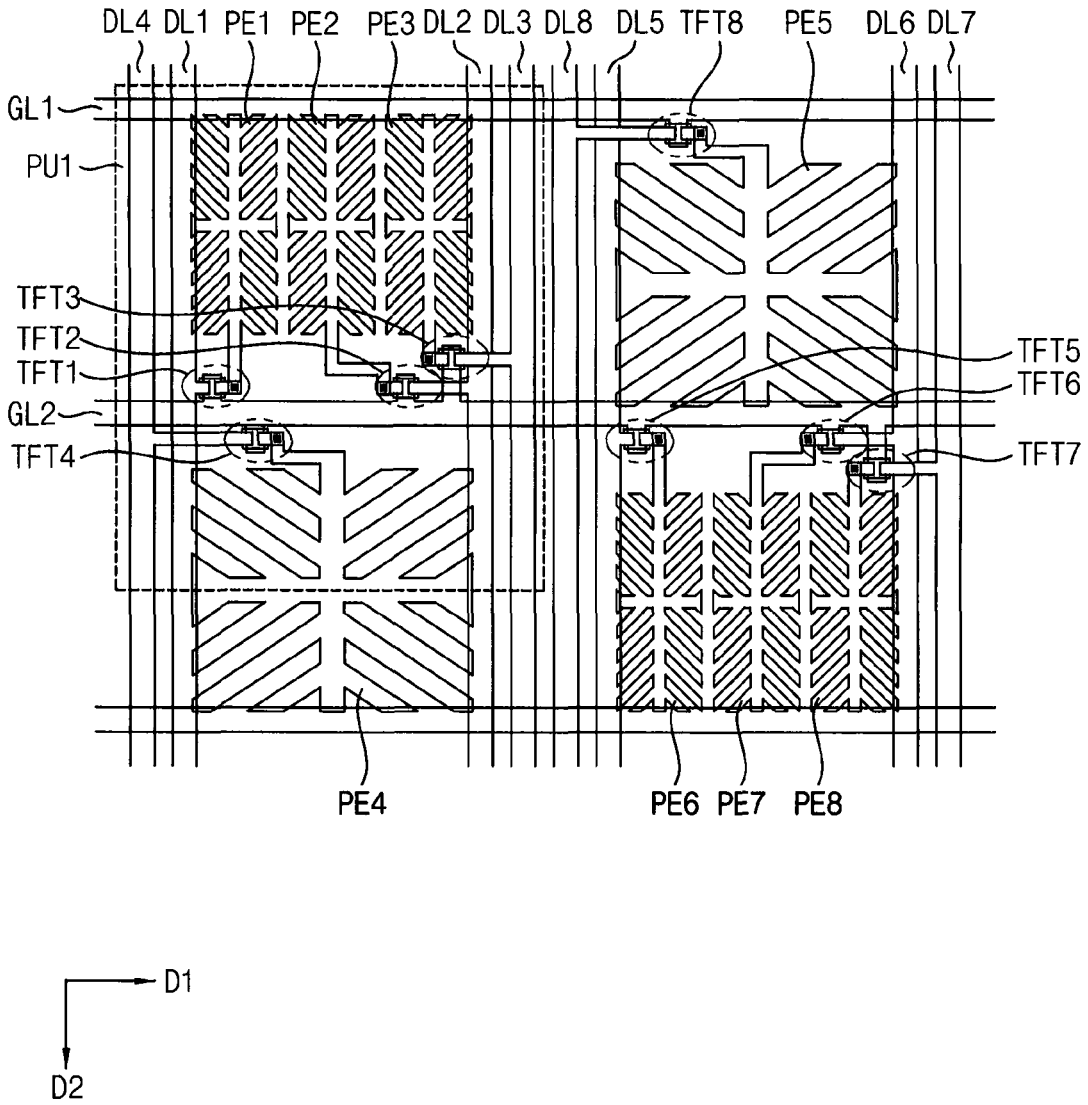
FIG. 11 is a plan view illustrating a pixel structure of an LCD panel according to an exemplary embodiment of the invention.
Figure 12:
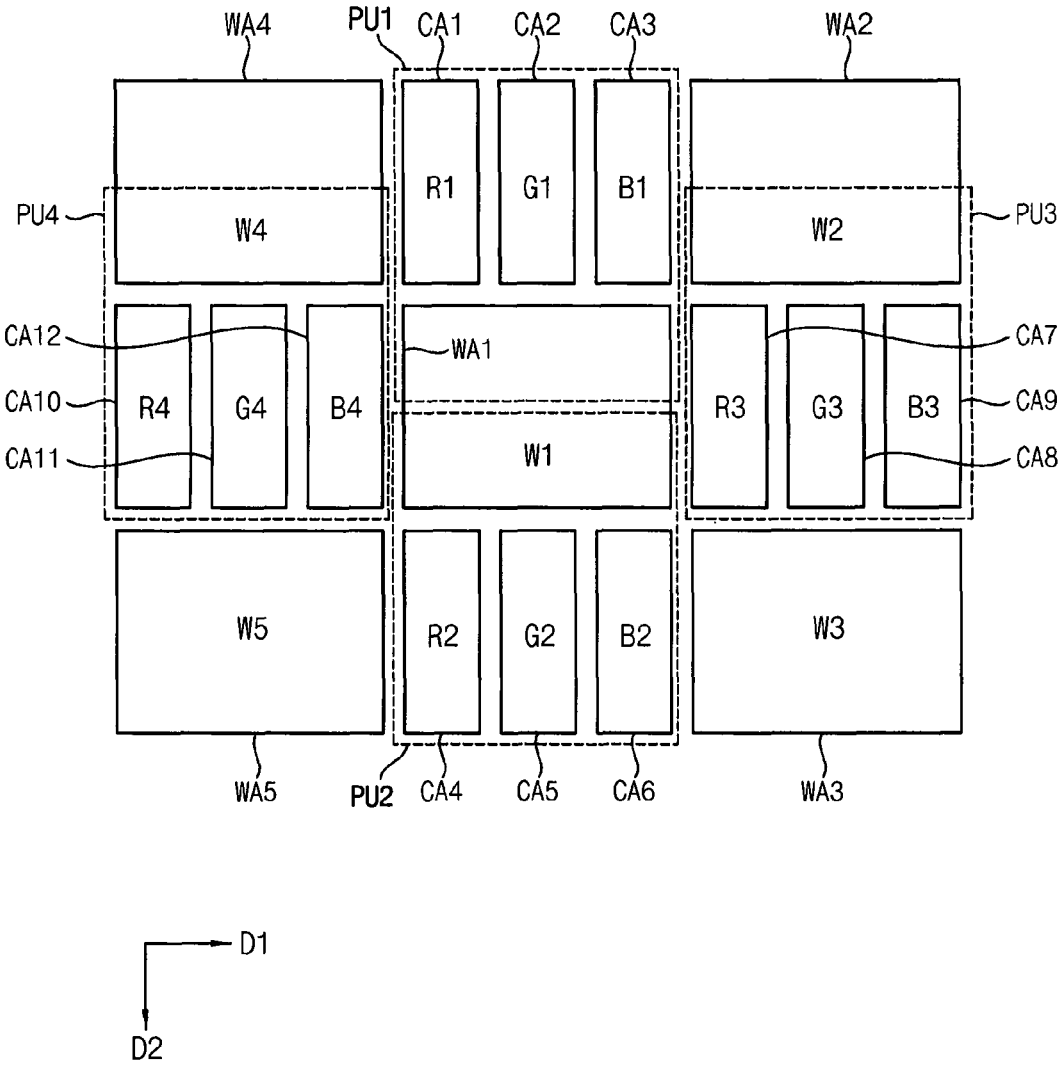
FIG. 12 is a plan view illustrating light transmitting areas of the LCD panel in FIG. 11.
Figure 13:
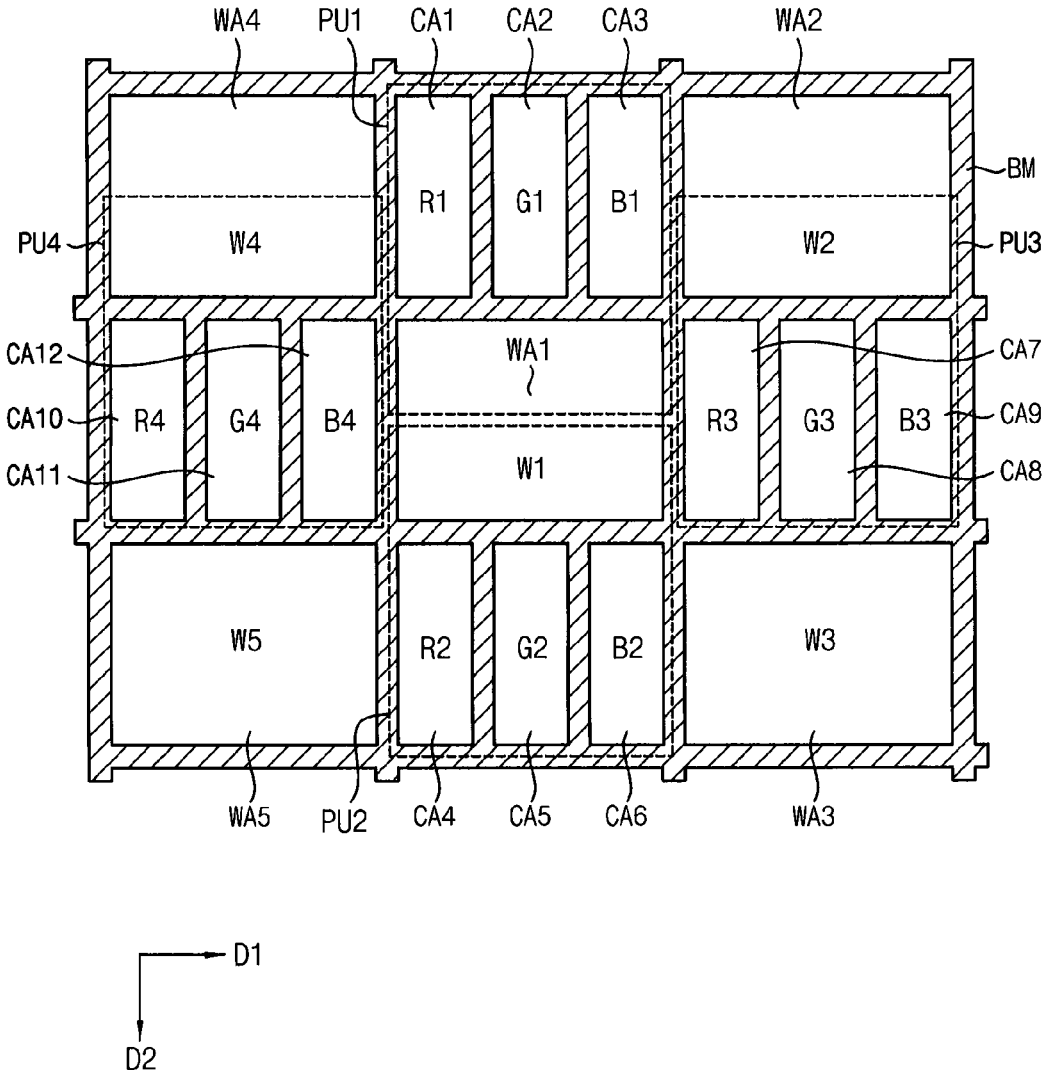
FIG. 13 is a plan view illustrating a light blocking pattern of the LCD panel in FIG. 11.

FIG. 11 is a plan view illustrating a pixel structure of an LCD panel according to an exemplary embodiment of the invention. FIG. 12 is a plan view illustrating light transmitting areas of the LCD panel in FIG. 11. FIG. 13 is a plan view illustrating a light blocking pattern of the LCD panel in FIG. 11.

Referring to FIGS. 11, 12 and 13, a pixel structure of an LCD panel according to the illustrated exemplary embodiment is substantially the same as the pixel structure illustrated in FIG. 7 except that unit pixels PU1, PU3 and PU4 are disposed in a zigzag shape along a first direction D1. In an exemplary embodiment, in the illustrated exemplary embodiment, RGB color areas and a white area may be alternately disposed along the first direction D1. Hereinafter, the identical elements are briefly described.

Referring to FIG. 11, the LCD panel according to the illustrated exemplary embodiment may include a plurality of gate lines GL1 and GL2, a plurality of data lines DL1 to DL8, a plurality of pixel electrodes PE1 to PE8 and a plurality of switching elements TFT1 to TFT8. The switching elements TFT1 to TFT8 may be substantially the same as the switching element illustrated in FIGS. 3A and 3B.

A display area of the LCD panel may be divided by a plurality of unit pixels including a first unit pixel PU1. The first unit pixel PU1 may overlap a desired number of the pixel electrodes PE1 to PE8.

The gate lines GL1 and GL2 may extend in a first direction D1. The gate lines GL1 and GL2 may be arranged in a second direction D2 crossing the first direction D1. The gate lines GL1 and GL2 may include a first gate line GL1 and a second gate line GL2 adjacent to each other along the second direction D2.

The data lines DL1 to DL8 may extend in the second direction D2. The data lines DL1 to DL8 may be arranged in the first direction D1. The data lines DL1 to DL8 and the gate lines GL1 and GL2 may define a plurality of sub-pixel areas. However, the invention is not limited thereto, and the plurality of sub-pixel areas may not be defined by the data lines DL1 to DL8 and the gate lines GL1 and GL2. The data lines DL1 to DL8 may include a fourth data line DL4, a first data line DL1, a second data line DL2, a third data line DL3, an eighth data line DL8, a fifth data line DL5, a sixth data line DL6 and a seventh data line DL7 sequentially adjacent to one another along the first direction D1.

In an exemplary embodiment, the pixel electrodes PE1 to PE8 may include, e.g., a transparent conductive material.

The pixel electrodes PE1 to PE8 may include a first pixel electrode PE1, a second pixel electrode PE2 and a third pixel electrode PE3. The first pixel electrode PE1 may be electrically connected to the second gate line GL2 and the first data line DL1 by a first switching element TFT1. The second pixel electrode PE2 may be electrically connected to the second gate line GL2 and the second data line DL2 by a second switching element TFT2. The third pixel electrode PE3 may be electrically connected to the second gate line GL2 and the third data line DL3 by a third switching element TFT3.

The pixel electrodes PE1 to PE8 may include a fourth pixel electrode PE4. The fourth pixel electrode PE4 may be electrically connected to the second gate line GL2 and the fourth data line DL4 by a fourth switching element TFT4. The fourth pixel electrodes PE4 may be disposed oppositely to the first to the third pixel electrodes PE1 to PE3 with respect to the second gate line GL2.

The pixel electrodes PE1 to PE8 may include a sixth pixel electrode PE6, a seventh pixel electrode PE7 and an eighth pixel electrode PE8. The sixth pixel electrode PE6 may be electrically connected to the second gate line GL2 and the fifth data line DL5 by a fifth switching element TFT5. The seventh pixel electrode PE7 may be electrically connected to the second gate line GL2 and the sixth data line DL6 by a sixth switching element TFT6. The eighth pixel electrode PE8 may be electrically connected to the second gate line GL2 and the seventh data line DL7 by a seventh switching element TFT7.

The pixel electrodes PE1 to PE8 may include a fifth pixel electrode PE5. The fifth pixel electrode PE5 may be electrically connected to the first gate line GL1 and the eighth data line DL8 by an eighth switching element TFT8. The fifth pixel electrodes PE5 may be disposed oppositely to the sixth to the eighth pixel electrodes PE6 to PE8 with respect to the second gate line GL2.

Sizes of the pixel electrodes PE1 to PE8 may be different from one another. In an exemplary embodiment, the first to the third pixel electrodes PE1 to PE3 and the sixth to the eighth pixel electrodes PE6 to PE8 may have a first area, respectively. In an exemplary embodiment, the fourth and the fifth pixel electrodes PE4 and PE5 may have a second area. The second area may be substantially greater than the first area. In an exemplary embodiment, the second area may be about three times of the first area, for example.

In the illustrated exemplary embodiment, the data lines DL1 to DL4 may be disposed at border lines of the first unit pixel PU1.

Referring to FIGS. 11 and 12, the LCD panel may include a plurality of unit pixels PU1, PU2, PU3 and PU4. The unit pixels PU1 to PU4 may be arranged in a matrix shape along the first direction D1 and the second direction D2. The unit pixels PU1 to PU4 may include a red area through which red light transmits, a green area through which green light transmits, a blue area through which blue light transmits and a white area through which white light transmits. In the illustrated exemplary embodiment, the unit pixels PU1 to PU4 may be disposed in a zigzag shape along the first direction D1. In an exemplary embodiment, a fourth unit pixel PU4, a first unit pixel PU1 and a third unit pixel PU3 may be disposed in a zigzag shape.

The unit pixels PU1 to PU4 may include the first unit pixel PU1. The first unit pixel PU1 may include a first color area CAL a second color area CA2 and a third color area CA3. The first unit pixel PU1 may partially overlap a first white area WA1.

The unit pixels PU1 to PU4 may include a second unit pixel PU2. The second unit pixel PU2 may include a fourth color area CA4, a fifth color area CA5 and a sixth color area CA6. The second unit pixel PU2 may partially overlap the first white area WA1. The second unit pixel PU2 may be adjacent to the first pixel unit PU1 in the second direction D2.

The unit pixels PU1 to PU4 may include the third unit pixel PU3. The third unit pixel PU3 may include a seventh color area CA7, an eighth color area CA8 and a ninth color area CA9. The third unit pixel PU3 may partially overlap a second white area WA2. The third unit pixel PU3 may be adjacent to the first pixel unit PU1 in the first direction D1.

The unit pixels PU1 to PU4 may include the fourth unit pixel PU4. The fourth unit pixel PU4 may include a tenth color area CA10, an eleventh color area CA11 and a twelfth color area CA12. The fourth unit pixel PU4 may partially overlap a fourth white area WA4. The fourth unit pixel PU4 may be disposed oppositely to the third unit pixel PU3 with respect to the first pixel unit PU1.

Referring to FIG. 12, a pixel structure in the LCD panel according to the illustrated exemplary embodiment may include the fourth white area WA4, the first to the third color areas CA1 to CA3 and the second white area WA2 along the first direction D1 in an upper row. The pixel structure may include the tenth to the twelfth color areas CA10 to CA12, the first white area WA1 and the seventh to the ninth color areas CA7 to CA9 along the first direction D1 in a middle row. The pixel structure may include a fifth white area WA5, the fourth to the sixth color areas CA4 to CA6 and a third white area WA3 in a lower row.

The first to the third color areas CA1 to CA3, the fourth to the sixth color areas CA4 to CA6, the seventh to the ninth color areas CA7 to CA9 and the tenth to the twelfth color areas CA10 to CA12 may be, e.g., the red area, the green area and the blue area, respectively.

Data voltages having a first red value R1, a first green value G1 and a first blue value B1 may be applied to the first pixel electrode PE1, the second pixel electrode PE2 and the third pixel electrode PE3 which overlap the first color area CA1, the second color area CA2 and the third color area CA3 of the first unit pixel PU1, respectively. Data voltages having a second red value R2, a second green value G2 and a second blue value B2 may be applied to the pixel electrodes which overlap the fourth color area CA4, the fifth color area CA5 and the sixth color area CA6 of the second unit pixel PU2, respectively. Data voltages having a third red value R3, a third green value G3 and a third blue value B3 may be applied to the sixth pixel electrode PE6, the seventh pixel electrode PE7 and the eighth pixel electrode PE8 which overlap the seventh color area CA7, the eighth color area CA8 and the ninth color area CA9 of the third unit pixel PU3, respectively. Data voltages having a fourth red value R4, a fourth green value G4 and a fourth blue value B4 may be applied to the pixel electrodes which overlap the tenth color area CA10, the eleventh color area CA11 and the twelfth color area CA12 of the fourth unit pixel PU4, respectively.

A data voltage applied to the fourth pixel electrode PE4 which overlaps the first white area WA1 and partially covers both the first unit pixel PU1 and the second unit pixel PU2 may be determined based on color values of the color areas CA1 to CA12 in the first to the fourth unit pixels PU1 to PU4.

In an exemplary embodiment, a first white value W1 applied to the fourth pixel electrode PE4 may be one of a minimum value, a maximum value and an average value among the first to the fourth red values R1 to R4, the first to the fourth green values G1 to G4, the first to the fourth blue values B1 to B4.

Referring to FIG. 13, boundaries of the color areas CA1 to CA12 and the white areas WA1 to WA4 may be covered by a light blocking pattern BM. In an exemplary embodiment, the light blocking pattern BM may overlap the gate lines GL1 and GL2, the data lines DL1 to DL8 and the switching elements TFT1 to TFT8.

A plurality of opening areas may be defined in the light blocking pattern BM. The opening areas may overlap the color areas CA1 to CA12 and the white areas WA1 to WA4. In an exemplary embodiment, first opening areas which overlap the color areas CA1 to CA12 may be defined in the light blocking pattern BM. In an exemplary embodiment, one of the first opening areas may overlap the first color area CA1. Also, second opening areas which overlap the white areas WA1 to WA4 may be defined in the light blocking pattern BM. In an exemplary embodiment, one of the second opening areas may overlap the first white area WA1. The second opening areas may be substantially greater than the first opening areas in size. In an exemplary embodiment, widths of the second opening areas along the first direction D1 may be greater than about two times and smaller than about three times of a width of one of the first opening areas, for example.

Figure 14:
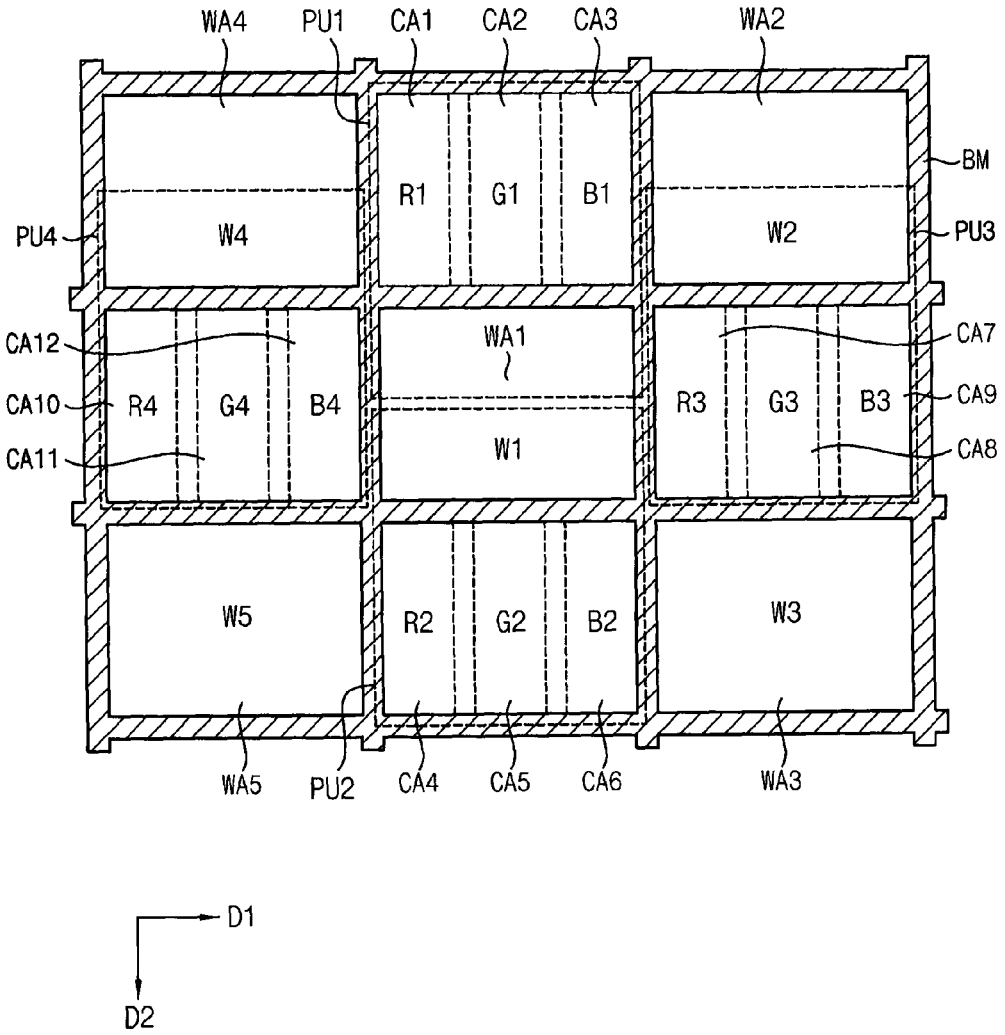
FIG. 14 is a plan view illustrating a light blocking pattern of the LCD panel in FIG. 11.

FIG. 14 is a plan view illustrating a light blocking pattern of the LCD panel in FIG. 11.

Referring to FIGS. 11, 13 and 14, a second opening area defined in a light blocking pattern BM of the LCD panel may be substantially equal to a first opening area in size. In an exemplary embodiment, the first to the third color areas CA1 to CA3 of the first unit pixel PU1 may overlap the first opening area of the light blocking pattern BM. Accordingly, transmissivity of the LCD panel may be improved, thereby increasing luminance of a display image.

As mentioned above, according to one or more exemplary embodiment of the LCD panel, the white areas in the unit pixels in a RGBW pixel structure may overlap a pixel electrode which is greater in size and broader in slit-width than individual color areas (i.e., a red area, a green area and a blue area) in the unit pixels, and the pixel electrode may be independently or dependently driven from the color areas, thereby reducing diffraction of backlight due to white domain size and improving color-sharpness of a display image.

Also, adjacent unit pixels may share a single white area, thereby reducing number of switching elements for controlling a pixel electrode overlapping the single white area and improving yield rate of the LCD panel.

Furthermore, the opening area of the light blocking pattern covering the switching elements may be broaden, thereby improving transmissivity of the LCD panel.

The foregoing is illustrative of exemplary embodiments and is not to be construed as limiting thereof. Although a few exemplary embodiments have been described, those skilled in the art will readily appreciate that many modifications are possible in exemplary embodiments without materially departing from the novel teachings and advantages of the invention. Accordingly, all such modifications are intended to be included within the scope of exemplary embodiments as defined in the claims. In the claims, means-plus-function clauses are intended to cover the structures described herein as performing the recited function and not only structural equivalents but also equivalent structures. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A liquid crystal display panel comprising:

a plurality of unit pixels which comprises:

a first unit pixel and a second unit pixel which are adjacent to each other, each of the first unit pixel and the second unit pixel comprising a first white area, a first color area, a second color area and a third color area different from each other;

a plurality of gate lines which extends in a first direction, crosses the plurality of unit pixels and comprises:

a first gate line and a second gate line adjacent to each other;

a plurality of data lines which extends in a second direction which crosses the first direction; and a plurality of pixel electrodes which is electrically connected to the plurality of data lines and comprises a first pixel electrode, a second pixel electrode, a third pixel electrode, a fourth pixel electrode, a fifth pixel electrode, a sixth pixel electrode and a seventh pixel electrode, wherein:

the first to the third pixel electrodes overlap the first to the third color areas of the first unit pixel, respectively, the fourth to the sixth pixel electrodes overlap the first to the third color areas of the second unit pixel, respectively, the seventh pixel electrode is disposed between the first gate line and the second gate line and overlaps the first white area of the first unit pixel and the first white area of the second unit pixel, the second unit pixel is adjacent to the first unit pixel in the second direction, the plurality of unit pixels further comprises a third unit pixel adjacent to the first unit pixel in the first direction and a fourth unit pixel adjacent to the third unit pixel in the second direction, and each of the third unit pixel and the fourth unit pixel comprises a first color area, a second color area and a third color area, the first unit pixel further comprises a second white area adjacent to the first white area thereof in the first direction, and the second white area overlaps an eighth pixel electrode which partially overlaps the second unit pixel, the third unit pixel and the fourth unit pixel, the eighth pixel electrode being adjacent to the seventh pixel electrode in the first direction.

2. The liquid crystal display panel of claim 1, wherein the first to the third pixel electrodes are arranged along the first direction, and wherein dispositions of the fourth to the sixth pixel electrodes are substantially symmetrical to dispositions of the first to the third pixel electrodes with respect to the seventh pixel electrode.

3. The liquid crystal display panel of claim 1, wherein a second size of the seventh pixel electrode is substantially greater than a first size of one of the first pixel electrode, the second pixel electrode and the third pixel electrode.

4. The liquid crystal display panel of claim 3, wherein the second size is greater than two times the first size and less than three times the first size.

5. The liquid crystal display panel of claim 1, wherein a plurality of slits tilted from the first direction and the second direction is defined in the plurality of pixel electrodes, respectively, and wherein a first width of each of the plurality of slits of one of the first pixel electrode, the second pixel electrode and the third pixel electrode is substantially equal to or less than a second width of each of the plurality of slits of the seventh pixel electrode.

6. The liquid crystal display panel of claim 1, wherein the first to the third color areas of the first unit pixel is disposed at a first side of the first gate line, and the first white area of the first unit pixel is disposed at a second side of the first gate line opposite to the first side of the first gate line, and wherein the first to the third color areas of the second unit pixel is disposed at a first side of the second gate line, and the first white area of the second unit pixel is disposed at a second side of the second gate line opposite to the first side of the second gate line.

7. The liquid crystal display panel of claim 1, wherein the seventh pixel electrode is electrically connected to the first gate line.

8. The liquid crystal display panel of claim 1, wherein the seventh pixel electrode is electrically connected to the second gate line, and the first gate line and the second gate line are configured to receive synchronized gate signals.

9. The liquid crystal display panel of claim 1, wherein the plurality of data lines comprises:

a first data line electrically connected to the first pixel electrode and the fourth pixel electrode;

a second data line electrically connected to the second pixel electrode and the fifth pixel electrode;

a third data line electrically connected to the third pixel electrode and the sixth pixel electrode; and a fourth data line electrically connected to the seventh pixel electrode.

10. The liquid crystal display panel of claim 9, wherein at least one of the first data line, the second data line, the third data line and the fourth data line is disposed between two pixel electrodes among the first pixel electrode, the second pixel electrode and the third pixel electrode.

11. The liquid crystal display panel of claim 9, wherein the second unit pixel is adjacent to the first unit pixel in the second direction, and wherein a seventh data voltage applied to the seventh pixel electrode via the fourth data line is determined based on first to sixth data voltages respectively applied to the first to the sixth pixel electrodes.

12. The liquid crystal display panel of claim 11, wherein the seventh data voltage is one of a minimum value, a maximum value and an average value among the first to the sixth data voltages.

13. The liquid crystal display panel of claim 1, wherein the plurality of pixel electrodes further comprises:

a ninth pixel electrode, a tenth pixel electrode and an eleventh pixel electrode overlapping the first color area, the second color area and the third color area of the third unit pixel respectively; and a twelfth pixel electrode, a thirteenth pixel electrode and a fourteenth pixel electrode overlapping the first color area, the second color area and the third color area of the fourth unit pixel respectively, and wherein an eighth data voltage applied to the eighth pixel electrode is one of a minimum value, a maximum value and an average value among first to sixth data voltages respectively applied to the first to the sixth pixel electrodes and ninth to fourteenth data voltages respectively applied to the ninth to the fourteenth pixel electrodes.

14. The liquid crystal display panel of claim 1, further comprising:

a light blocking pattern overlapping the plurality of gate lines and the plurality of data lines, and a plurality of opening areas defined in the light blocking pattern.

15. The liquid crystal display panel of claim 14, wherein the light blocking pattern comprises:

a plurality of first opening areas respectively overlapping the first color areas, the second color areas and the third color areas of the first and the second unit pixels; and a second opening area overlapping the first white areas of the first and the second unit pixels, and wherein the second opening area is disposed between the first gate line and the second gate line.

16. The liquid crystal display panel of claim 15, wherein a first area of the first opening area overlapping the first unit pixel is substantially the same as a second area of the second opening area.

17. A liquid crystal display panel comprising:

a plurality of unit pixels which comprises:

a first unit pixel and a second unit pixel which are adjacent to each other, each of the first unit pixel and the second unit pixel comprising a first white area, a first color area, a second color area and a third color area different from each other;

a plurality of gate lines which extends in a first direction, crosses the plurality of unit pixels and comprises:

a first gate line and a second gate line adjacent to each other;

a plurality of data lines which extends in a second direction which crossed the first direction; and a plurality of pixel electrodes which is electrically connected to the plurality of data lines and comprises a first pixel electrode, a second pixel electrode, a third pixel electrode, a fourth pixel electrode, a fifth pixel electrode, a sixth pixel electrode and a seventh pixel electrode, wherein:

the first to third pixel electrodes overlap the first to the third color areas of the first unit pixel, respectively, the fourth to sixth pixel electrodes overlap the first to the third color areas of the second unit pixel, respectively, the seventh pixel electrode is disposed between the first gate line and the second gate line and overlaps the first white area of the first unit pixel and the first white area of the second unit pixel, wherein the plurality of unit pixels further comprises:

a third unit pixel adjacent to the first unit pixel in the first direction; and a fourth unit pixel opposite to the third unit pixel with respect to the first unit pixel therebetween, each of the third unit pixel and the fourth unit pixel comprises a first color area, a second color area and a third color area; and wherein the first color area, the second color area and the third color area of the third unit pixel and the first color area, the second color area and the third color area of the fourth unit pixel are disposed between the first gate line and the second gate line, wherein the pixel electrode further comprise:

a ninth pixel electrode, a tenth pixel electrode and an eleventh pixel electrode overlapping the first to the third color areas of the third unit pixel respectively; and a twelfth pixel electrode, a thirteenth pixel electrode and a fourteenth pixel electrode overlapping the first to the third color areas of the fourth unit pixel respectively, wherein the first unit pixel further comprises a second white area adjacent to the first white area thereof in the first direction, wherein the second white area overlaps an eight pixel electrode which partially overlaps the second unit pixel, the third unit pixel and the fourth unit pixel, the eight pixel electrode being adjacent to the seventh pixel electrode in the first direction, and wherein an eighth data voltage applied to the eighth pixel electrode is one of a minimum value, a maximum value and an average value among the first to sixth data voltages respectively applied to the first to the sixth pixel electrodes and ninth to fourteenth data voltages respectively applied to the ninth to the fourteenth pixel electrodes.

18. The liquid crystal display panel of claim 17, wherein the fourth unit pixel, the first unit pixel and the third unit pixel are disposed in a zigzag shape along the first direction.

* * * * *